US010919677B2

(12) United States Patent
Chevalier

(10) Patent No.: US 10,919,677 B2
(45) Date of Patent: Feb. 16, 2021

(54) CUTOUTS FOR PRIMARY AND/OR SECONDARY AND/OR TERTIARY PACKAGING AND PACKAGING OBTAINED WITH SUCH CUTOUTS

(71) Applicant: Pierre Chevalier, Lechatelet (FR)

(72) Inventor: Florence Chevalier, Lechatelet (FR)

(73) Assignee: Pierre Chevalier, Lechatelet (FR)

( * ) Notice: Subject to any disclaimer, the term of this patent is extended or adjusted under 35 U.S.C. 154(b) by 0 days.

(21) Appl. No.: 16/465,099

(22) PCT Filed: Dec. 1, 2017

(86) PCT No.: PCT/EP2017/081269
§ 371 (c)(1),
(2) Date: May 29, 2019

(87) PCT Pub. No.: WO2018/100194
PCT Pub. Date: Jun. 7, 2018

(65) Prior Publication Data

US 2019/0291932 A1 Sep. 26, 2019

(30) Foreign Application Priority Data

Dec. 1, 2016 (FR) ..... 1661804

(51) Int. Cl.
*B65D 71/38* (2006.01)
*B65D 5/32* (2006.01)
(Continued)

(52) U.S. Cl.
CPC ..... *B65D 71/38* (2013.01); *B65D 5/32* (2013.01); *B65D 5/321* (2013.01); *B65D 5/42* (2013.01); *B31B 2105/002* (2017.08)

(58) Field of Classification Search
CPC ..... B65D 71/38; B65D 5/32; B65D 5/321; B65D 5/42; B65D 5/0095; B65D 21/086;
(Continued)

(56) References Cited

U.S. PATENT DOCUMENTS 1,654,225 A * 12/1927 Hussey ..... B65D 9/12 217/13
3,531,045 A * 9/1970 Johnson ..... B65D 5/5445 229/240
(Continued)

FOREIGN PATENT DOCUMENTS

DE 202010010665 U1 10/2010
FR 2783803 A 3/2000
(Continued)

OTHER PUBLICATIONS

International Search Report dated Mar. 19, 2018, issued in corresponding International Application No. PCT/EP2017/081269, filed Dec. 1, 2017, 2 pages.
(Continued)

*Primary Examiner* — Christopher R Demeree
(74) *Attorney, Agent, or Firm* — Christensen O'Connor Johnson Kindness PLLC

(57) ABSTRACT

A packaging comprising two detachable elements respectively formed from cutouts of sheet-form card or corrugated card material, a first element forming the base of the packaging and a second element forming the lid of the packaging, the cutouts of the first and second elements comprising two main flaps, a first main flap forming the bottom of the packaging and the top of the packaging respectively, and a second main flap forming the side walls of the packaging, the flaps being connected by a first fold line directly or by a secondary flap, and a set of lateral tabs arranged on either side of at least one of the main flaps and connected to the main flaps by second fold lines perpen-
(Continued)

dicular to the first fold line so that the elements exhibit the overall shape of a letter L; the packaging being notable in that the first main flap of the cutouts of the first and second elements is of quadrilateral shape and the four corners thereof are chamfered.

31 Claims, 14 Drawing Sheets

(51) Int. Cl.
*B65D 5/42* (2006.01)
*B31B 105/00* (2017.01)

(58) Field of Classification Search
CPC ..... B65D 2571/00666; B65D 5/545; B65D 5/5495; B65D 11/105; B65D 11/188
USPC .... 229/122.24, 164, 235, 103; 206/736, 774
See application file for complete search history.

(56) References Cited

U.S. PATENT DOCUMENTS 3,744,700 A * 7/1973 Stegmann ..... B65D 5/324 229/122.23
5,590,788 A * 1/1997 Inman ..... B65D 5/32 206/736
6,135,289 A 10/2000 Miller
6,755,306 B2 * 6/2004 Maus ..... B65D 5/5405 206/774
6,974,033 B2 * 12/2005 McLeod ..... B65D 5/4204 206/736
2017/0267398 A1 * 9/2017 Couture ..... B65D 5/0227

FOREIGN PATENT DOCUMENTS

JP 2004203471 A 7/2004
JP 2009241958 A 10/2009
JP 2014148357 A 8/2014

OTHER PUBLICATIONS

Written Opinion of the International Searching Authority dated Mar. 19, 2018, issued in corresponding International Application No. PCT/EP2017/081269, filed Dec. 1, 2017, 4 pages.
Written Opinion of the International Searching Authority dated Jun. 4, 2019, issued in corresponding International Application No. PCT/EP2017/081269, filed Dec. 1, 2017, 1 page.

* cited by examiner

CUTOUTS FOR PRIMARY AND/OR SECONDARY AND/OR TERTIARY PACKAGING AND PACKAGING OBTAINED WITH SUCH CUTOUTS

TECHNICAL SCOPE

The present invention relates to a packaging, and more particularly a packaging made of a semi-rigid material, such as, for example, corrugated or sheet-form card material or a similar material, intended to hold products for their store and transport and, as necessary, to be turned into a display packaging in which the products are displayed for sale, such as a "Shelf Ready Packaging" or a RRP, for "Retail Ready Packaging". The term "products" is used to describe sales units or logistics units. These various types of packaging, regardless of their combined or individual purposes, are commonly known as primary packaging, secondary packaging or tertiary packaging by product packagers and their logistician or distribution customers.

STATE OF THE ART

In the field of packaging, the use of retail ready packaging is well known and allows significant savings in terms of time and cost, with respect to conventional packaging, for which it was necessary to remove the products in order to place them on the shelving of retail areas.

This is the case, in particular, for document EP 0 965 528, which describes a box with eight panels of sheet-form card made from a preform comprising a succession of eight rectangular flaps forming the side walls of the box and ended by a rectangular attachment strip, said flaps and said strip being connected to one another by first fold lines parallel to one another, i.e. four main flaps separated in pairs by four intermediate flaps, said intermediate flaps not having a tab, a first set of lateral tabs arranged on one side and connected to the primary flaps by second fold lines and forming at least partially the bottom of the box, and a second set of lateral tabs arranged on the other side of the flaps forming the side walls, to which it is connected by third fold lines perpendicular to the first fold lines and intended to form at least partially the lid of said box. The free sides of the intermediate flaps oriented towards the side of the tabs comprise protrusions, and the free sides of the intermediate flaps oriented towards the side of the tabs comprise indentations. Thus, the end flap of the succession of flaps and the strip on one side, and the tabs on the either side, are secured by applying them onto one another and by gluing, said box being mounted automatically by folding back said flaps and the tabs of said first set around a mandrel.

Retail ready packaging is also known, said packaging being formed by parallelepiped packaging comprising a peripheral cut line delimiting the base and the lid of the packaging and enabling the removal of the lid, after cutting operations along the peripheral cut line, to render accessible the products contained in the base, which is directly placed on the shelves of stores. Specifically, this is the case for Japanese patent application JP2009241958 and U.S. Pat. No. 6,135,289.

Document JP2009241958 and document U.S. Pat. No. 6,135,289 describe a retail ready packaging cardboard box comprising a peripheral wall formed by a front wall, a pair of side walls and a rear wall. An inclined cut line is provided in the two side walls so that the upper part of the cardboard packaging can be removed by breaking the cardboard packaging along the cut line to convert the cardboard packaging into a display for products.

French patent application FR 2 783 803 discloses a packaging made of a semi-rigid material that can be turned into a display. The packaging comprises a corrugated cardboard box closed at one end, open at the other end, and comprising at least three side walls, one of said side walls having a low-resistance line, the ends of which extend to the upper edge of said side wall, and that defines internally a tear-away pre-cut, and a lid made of corrugated cardboard material comprising a bottom wall and a side skirt, said lid covering the open end of the box and being secured thereto, by gluing the skirt on said pre-cut and on at least another wall of the box.

All these types of cardboard packaging have the disadvantages of being costly, considering the quantity of raw material used for each packaging, in particular the significant paper grade used, and of featuring insufficient mechanical resistance, in particular for packaging in the form of a box with pre-cuts and/or of the type comprising a tray and a lid, and are therefore unable to withstand the constraints of modern logistics, such as automatic palletising or processing on platforms for bulky product.

PRESENTATION OF THE INVENTION

One of the purposes of the invention is therefore to overcome these disadvantages by providing a retail ready packaging and/or a grouping and shipping packaging of simple and inexpensive design, featuring high mechanical resistance and easily formed by means of a flat forming machine by pressing-bending or around a forming mandrel.

Therefore and according to the invention, a packaging is proposed comprising two detachable elements respectively formed from cutouts of sheet-form card or corrugated card material, a first element forming the base of the packaging and a second element forming the lid of the packaging; said packaging is notable in that the cutouts of the first and second elements comprise two main flaps, the cutouts of the first and second elements comprising a first main flap forming the bottom of the packaging and the top of the packaging respectively, of quadrilateral shape and the four corners thereof are chamfered, and a second main flap forming the side walls of the packaging, also of quadrilateral shape, said flaps being connected by a first fold line directly or by means of a secondary flap, and a set of lateral tabs arranged on either side of at least one of said main flaps and connected to said main flaps by second fold lines perpendicular to the first fold line so that said elements exhibit the overall shape of a letter L.

Preferably, the first main flap is of rectangular shape and the four corners thereof are chamfered and the second main flap is of rectangular shape, the long side of which is shorter than the long side of the first main flap.

Preferably, the lateral tabs of the first main flap have a length that is longer than the long side of said first flap, between two chamfered corners.

Furthermore, the lateral tabs of the first main flap protrude from the chamfered corners in the direction of the second main flap.

Moreover, each lateral tab of the first main flap comprises a third fold line, parallel to the first fold line and extending in the part protruding from the chamfered corner.

Furthermore, the lateral tabs of the first main flap protrude from the chamfered corners in the direction opposite that of the second main flap.

Moreover, each lateral tab of the first main flap comprises two third fold lines extending in the part protruding from the chamfered corner in the direction opposite that of the second main flap.

Preferably, the lateral tabs of the second main flap extend along the entire length of the long side of said second main flap.

Said lateral tabs of the second main flap have a width that is equal to the length of the chamfered corners of the first main flap.

Preferably, the first main flap is ended by an attachment strip connected to said first main flap by a first fold line.

According to another embodiment, the lateral tabs of the first main flap have a width that is equal to the length of the chamfered corners of the first main flap.

According to another embodiment, the lateral tabs of the first main flap have a width that is equal to the length of the long side of the second main flap.

Advantageously, the first main flap and/or the second main flap of at least one of the elements comprise an oblong cavity forming a gripping handle.

According to another embodiment, the lateral sides of the lateral tabs of the second main flap, opposite the first main flap, of a first element comprise respectively a tenon intended to be introduced in a mortise provided in the first main flap, at the level of the corners opposite the second main flap of a second element.

The cutouts of the first and second elements are identical or are different.

Another object of the invention relates to a cutout for packaging comprising two detachable elements respectively formed from cutouts of sheet-form card or corrugated card material, a first element forming the base of the packaging and a second element forming the lid of the packaging; said cutout is notable in that it comprises two main flaps, a first main flap of quadrilateral shape and the four corners thereof being chamfered, and a second main flap, also of quadrilateral shape, said flaps being connected by a first fold line directly or by means of a secondary flap, and a set of lateral tabs arranged on either side of at least one of said main flaps and connected to said main flaps by second fold lines perpendicular to the first fold line.

Preferably, the first main flap is of rectangular shape and the four corners thereof are chamfered and the second main flap is of rectangular shape, the long side of which is shorter than the long side of the first main flap.

Furthermore, the lateral tabs of the first main flap have a length that is longer than the long side of said first flap, between two chamfered corners.

Moreover, the lateral tabs of the first main flap protrude from the chamfered corners in the direction of the second main flap.

Furthermore, each lateral tab of the first main flap comprises a third fold line, parallel to the first fold line and extending in the part protruding from the chamfered corner.

Moreover, the lateral tabs of the first main flap protrude from the chamfered corners in the direction opposite that of the second main flap.

Each lateral tab of the first main flap comprises two third fold lines extending in the part protruding from the chamfered corner in the direction opposite that of the second main flap.

Preferably, the lateral tabs of the second main flap extend along the entire length of the long side of said second main flap.

Preferably, the lateral tabs of the second main flap have a width that is equal to the length of the chamfered corners of the first main flap.

According to another embodiment, the first main flap is ended by an attachment strip connected to said first main flap by a first fold line.

According to yet another embodiment, the lateral tabs of the first main flap have a width that is equal to the length of the chamfered corners of the first main flap.

According to another embodiment, the lateral tabs of the first main flap have a width that is equal to the length of the long side of the second main flap.

Advantageously, the first main flap and/or the second main flap comprise an oblong cavity forming a gripping handle.

According to another embodiment, the lateral sides of the lateral tabs of the second main flap, opposite the first main flap, comprise respectively a tenon intended to be introduced in a mortise provided in the first main flap, at the level of the corners opposite the second main flap of a second element.

Another object of the invention relates to a device for producing a packaging comprising two detachable elements respectively formed from cutouts of sheet-form card or corrugated card material, a first element forming the base of the packaging and a second element forming the lid of the packaging, said device is notable in that it comprises at least the means for extracting a first element constituting the packaging, the means for glue deposition on the predetermined zones of the base, the means for extracting a second cutout, also called lid, from the first store or from a second store, to place said second cutout so that it overlaps with the glued zones of the first cutout, static or fly pressing means of the two cutouts, and three-dimensional forming means of said cutouts.

According to a first embodiment, the three-dimensional forming means comprise at least a mandrel, folding means, gluing means, and pressing means of the tabs and the strips of the respective cutouts.

According to a second embodiment, the three-dimensional forming means comprise at least horizontal or vertical pressing means comprising a conforming tool that comprises folding means, gluing means, and pressing means of the tabs and the strips of the respective cutouts.

A final object of the invention relates to a method for manufacturing a packaging comprising two detachable elements respectively formed from cutouts of sheet-form card or corrugated card material, a first element forming the base of the packaging and a second element forming the lid of the packaging, notable in that it comprises at least the following steps:

- extraction of a first element constituting the packaging, called base, of a first store of cutouts;
- deposition of glue on predetermined zones of the base;
- extraction of a second cutout, called lid, from the first store or from a second store;
- placing said second cutout so that it overlaps with the glued zones of the first cutout;
- static or fly pressing of the two cutouts; and
- three-dimensional forming of said cutouts.

BRIEF DESCRIPTION OF THE FIGURES

Other advantages and characteristics will be made clearer upon reading the following description of various embodiments, provided by way of examples and not limited thereto, and with reference to the appended drawings wherein.

EMBODIMENT OF THE INVENTION

The following description relates to a packaging made of sheet-form card or corrugated card of the retail ready type or of the secondary packaging type; however, it should be noted that the packaging can naturally be intended for any other use and can be made of any other type of semi-rigid material without departing from the scope of the invention.

In the following description, the same reference numbers are used in reference to packaging elements and/or cutouts that are identical or that occupy the same position.

Figure 1:
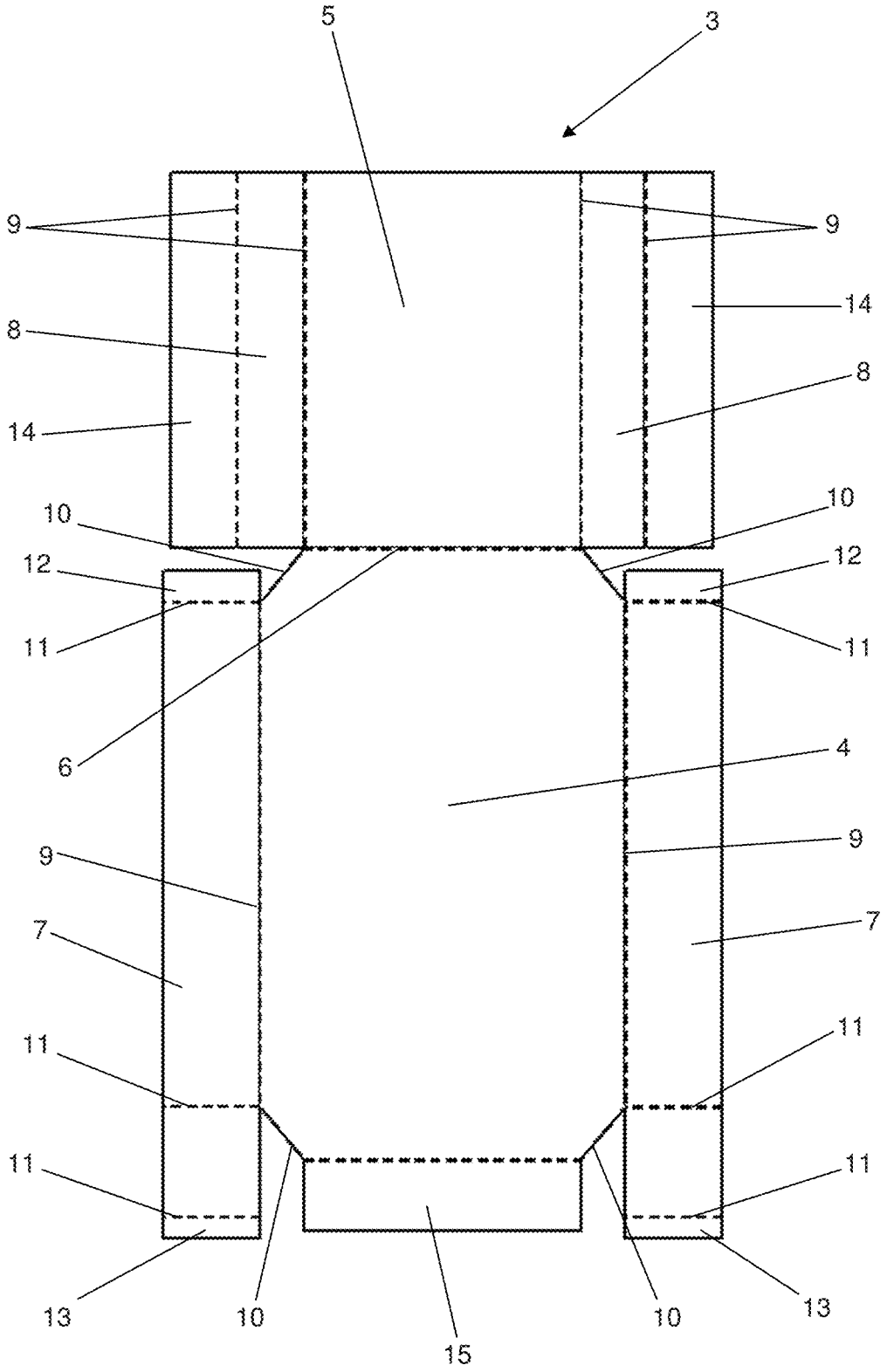
FIG. 1 is a top view of a cutout for producing a packaging according to the invention.
Figure 2:
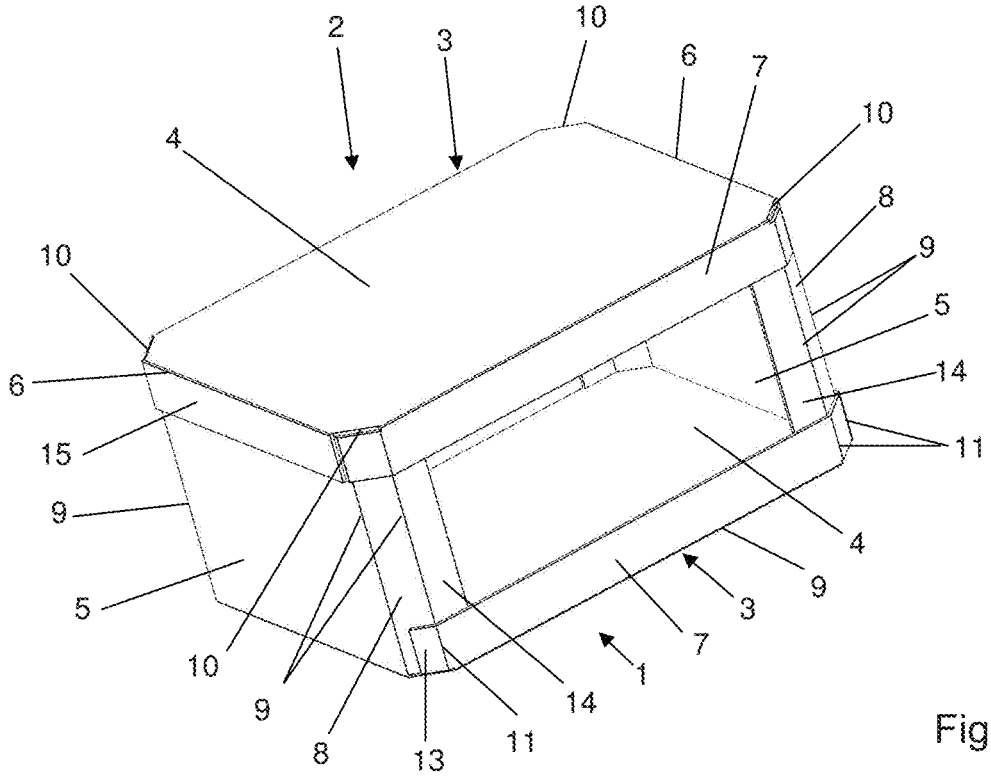
FIG. 2 is a perspective view of a packaging according to the invention.
Figure 3:
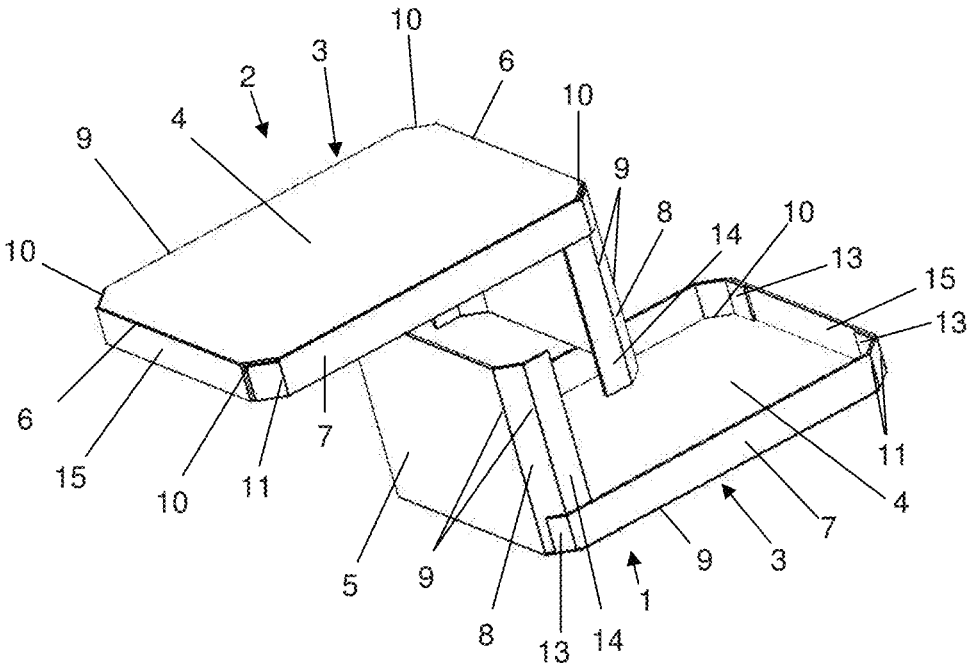
FIG. 3 is a perspective and exploded view of the packaging according to the invention shown in FIG. 2.

With reference to FIGS. 1 to 3, the packaging according to the invention comprises two elements, i.e. a first element forming the base 1 of the packaging and a second element forming the lid 2 of the packaging, said elements forming the base 1 and the lid 2 having a general L-shape, and being obtained from two identical cutouts 3. The base 1 and the lid 2 are secured by head-to-tail gluing to form a packaging that is substantially parallelepiped.

Each cutout 3 forming respectively the base 1 and the lid 2 of the packaging comprises two main flaps, a first main flap 4 forming the bottom of the packaging and respectively the top of the packaging, and a second main flap 5 forming the side walls of the packaging, said main flaps 4 and 5 being connected by a first fold line 6. The packaging also comprises a set of lateral tabs 7 and 8 respectively, arranged on either side of said main flaps 4 and 5 respectively, and connected to said main flaps 4 and 5 by second fold lines 9 perpendicular to the first fold line 6. The first main flap 4 is of rectangular shape and the four corners thereof are chamfered, thereby forming chamfered corners 10, and the second main flap 5 is of rectangular shape, the long side of which is shorter than the long side of the first main flap 4.

Furthermore, the lateral tabs 7 of the first main flap 4 have a length that is longer than the long side of said first flap 4, between two chamfered corners. In this specific embodiment example, the lateral tabs 7 of the first main flap 4 have a width that is shorter than the length of the second main flap 5, more specifically the lateral tabs 7 of the first main flap 4 have a width that is substantially equal to the length of the chamfered corners 10 of the first main flap 4, so that the products are visible on the longitudinal sides of the packaging. Moreover, the lateral tabs 7 of the first main flap 4 protrude from the chamfered corners 10 towards the second main flap 5 and each lateral tab 7 of the first main flap 4 comprises a third fold line 11, parallel to the first fold line 6 and extending in the part protruding from the chamfered corner 10, at the junction between the longitudinal side of the first main flap 4 and the chamfered corner, to form a strip 12 intended to be secured by gluing, for example, on the inner face of the tabs 8 of the second main flap 5. The lateral tabs 7 of the first main flap 4 protrude from the chamfered corners 10 in the direction opposite that of the second main flap 5. Each lateral tab 7 of the first main flap 4 comprises two third fold lines 11 that extend in the part protruding from the chamfered corner 10 in the direction opposite that of the second main flap 5, the third fold lines 11 extending to the angles of the chamfered corners and the distance between the two fold lines 11 being equal to the length of the chamfered corner 10, to form attachments strips 13. These attachment strips 13 allow securing the lid 2 to the base 1 or inversely. To assemble the base 1 and the lid 2, which are positioned head to tail, the inner walls of the attachment strips 13 of the base 1 and of the lid 2 are glued to the outer walls of the second main flap 5 of the lid 2 and of the base 1 respectively.

Moreover, said lateral tabs 8 of the second main flap 4 extend over the entire length of the long side of said second main flap 5, and said lateral tabs 8 have a width that is equal to the length of the chamfered corners 10 of the first main flap 4.

To rigidify the packaging, each cutout 3 comprises second lateral tabs 14 connected to the first lateral tabs 8 of the second main flap 5 by second fold lines 9, the width of said second lateral tabs 14 being substantially equal to the width of the first lateral tabs 7 in this specific embodiment example. It should be noted that the second lateral tabs 14 can have any width, as long as it is inferior or equal to the length of the longitudinal sides of the first main flap 4, without departing from the scope of the invention.

Furthermore, the first main flap 4 of each cutout 3 is ended by an attachment strip 15, substantially rectangular and extending between the two chamfered corners 10 of the end of said main flap, connected to said first main flap 4 by a fold line 6. The width of these attachment strips 15 is substantially equal to the width of the lateral tabs 7. To assemble the base 1 and the lid 2, which are positioned head to tail, the inner walls of the attachment strip 15 of the base 1 and of the lid 2 are glued to the outer walls of the second main flap 5 of the lid 2 and of the base 1 respectively.

Naturally, said main flaps 4 and 5 can be connected by means of a secondary flap, not shown in the figures, said main flaps 4 and 5 and the secondary flap being connected by parallel fold lines, without departing from the scope of the invention.

Figure 4:
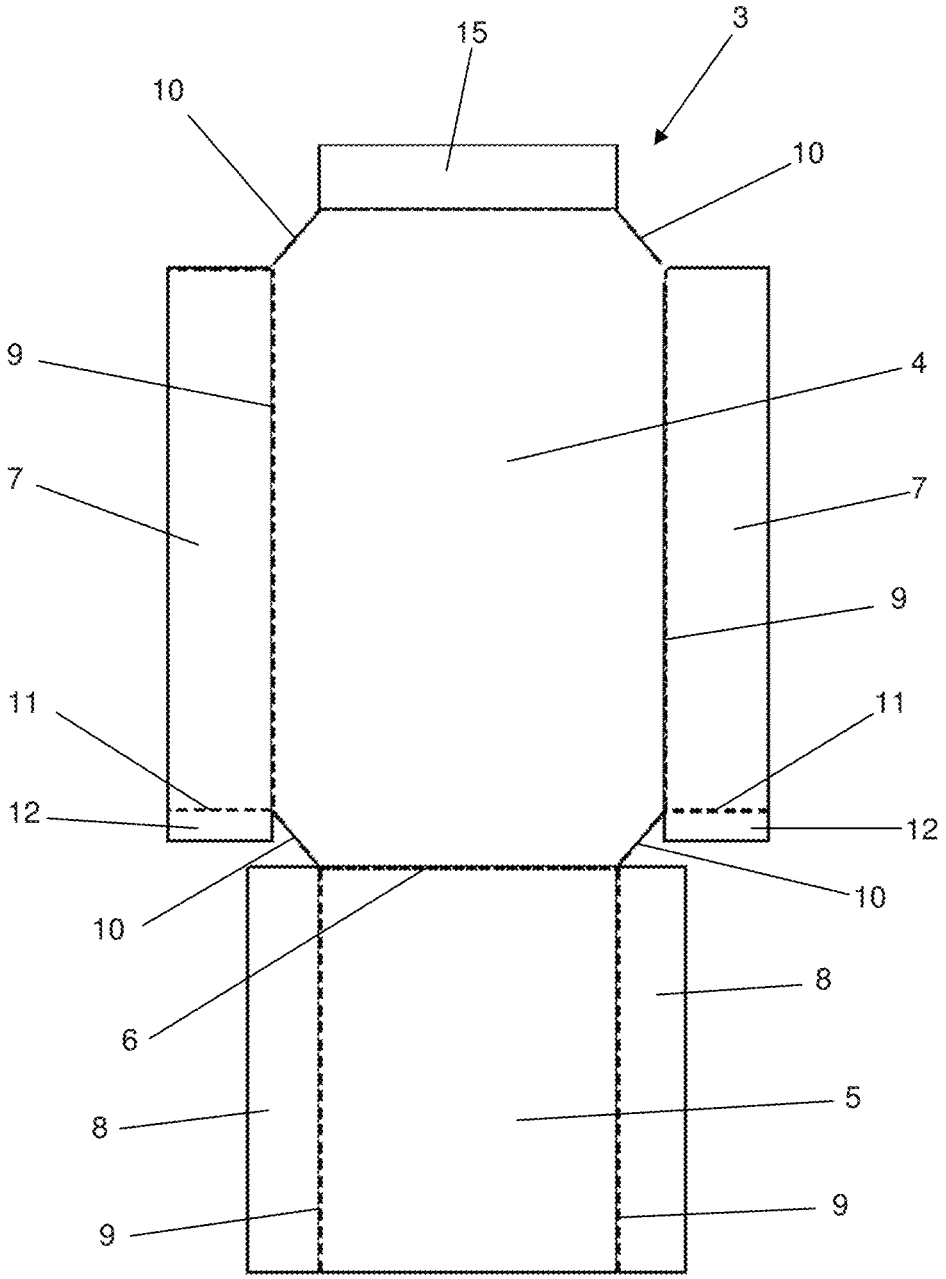
FIG. 4 is a top view of a cutout for producing a first embodiment version of the packaging according to the invention shown in FIGS. 5 and 6.
Figure 5:
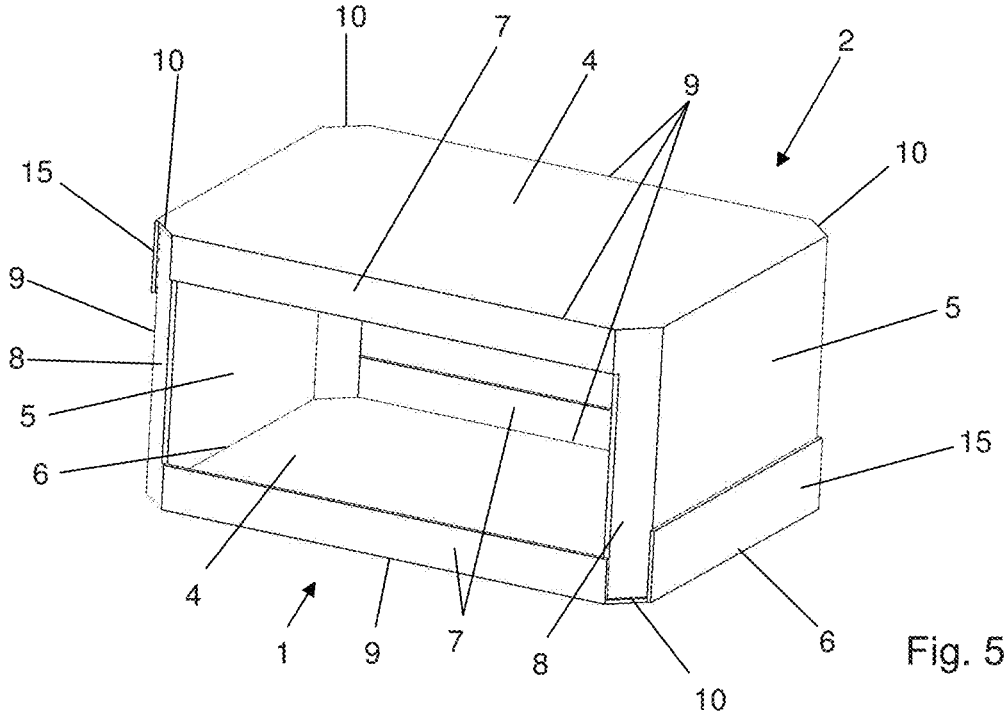
FIG. 5 is a perspective view of a first embodiment of the packaging according to the invention.
Figure 6:
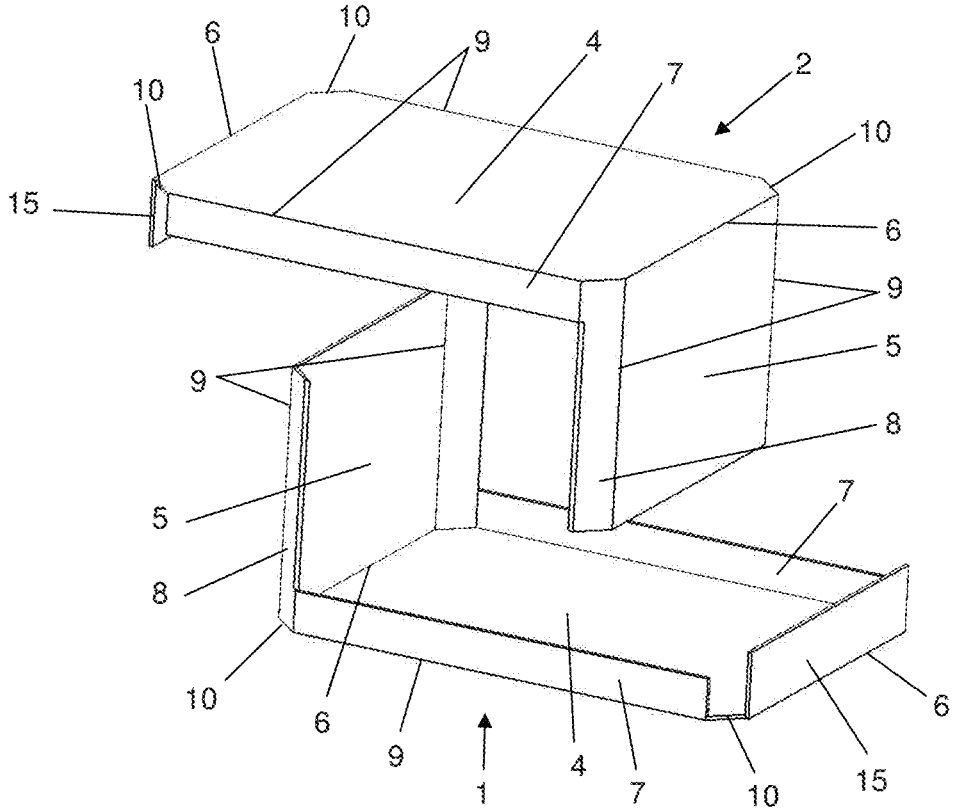
FIG. 6 is a perspective and exploded view of the first embodiment of the packaging shown in FIG. 5.

According to a first embodiment, and with reference to FIGS. 4 to 6, the packaging according to the invention comprises two elements, i.e. a first element forming the base 1 of the packaging and a second element forming the lid 2 of the packaging, said elements forming the base 1 and the lid 2 having a general L-shape, and being obtained from two identical cutouts 3 shown in FIG. 1. The base 1 and the lid are secured by head-to-tail gluing to form a packaging that is substantially parallelepiped.

Each cutout 3 forming respectively the base 1 and the lid 2 of the packaging comprises two main flaps, a first main flap 4 forming the bottom of the packaging and the top of the packaging respectively, and a second main flap 5 forming the side walls of the packaging, said main flaps 4 and 5 being connected by a first fold line 6. The packaging also comprises a set of lateral tabs 7 and 8 respectively, arranged on either side of said main flaps 4 and 5 respectively, and connected to said main flaps 4 and 5 by second fold lines 9 perpendicular to the first fold line 6. The first main flap 4 is of rectangular shape and the four corners thereof are chamfered, thereby forming chamfered corners 10, and the second main flap 5 is of rectangular shape, the long side of which is shorter than the long side of the first main flap 4.

Furthermore, the lateral tabs 7 of the first main flap 4 have a length that is longer than the long side of said first flap 4, between two chamfered corners. In this specific embodiment example, the lateral tabs 7 of the first main flap 4 have a width that is shorter than the length of the second main flap 5, more specifically the lateral tabs 7 of the first main flap 4 have a width that is substantially equal to the length of the chamfered corners 10 of the first main flap 4, so that the products are visible on the longitudinal sides of the packaging. Moreover, the lateral tabs 7 of the first main flap 4 protrude from the chamfered corners 10 towards the second main flap 5 and each lateral tab 7 of the first main flap 4 comprises a third fold line 11, parallel to the first fold line 6 and extending in the part protruding from the chamfered corner 10, at the junction between the longitudinal side of the first main flap 4 and the chamfered corner, to form a strip 12 intended to be secured by gluing, for example, on the inner face of the tabs 8 of the second main flap 5. The lateral tabs 8 of the second main flap 4 extend over the entire length of the long side of said second main flap 5, and said lateral tabs 8 have a width that is equal to the length of the chamfered corners 10 of the first main flap 4.

The lateral tabs 7, once they are folded perpendicular to the main flap 4, form longitudinal walls of the packaging and the lateral tabs 8, once they are folded perpendicular to the main flap 5, form the chamfered panels to produce an "eight-panel" packaging that features great mechanical resistance, in particular under vertical compression.

In order the secure the lid 2 to the base 1 or inversely, the first main flap 4 of each cutout 3 is ended by an attachment strip 15, substantially rectangular and extending between the two chamfered corners 10 of the end of said main flap, connected to said first main flap 4 by a fold line 6. To assemble the base 1 and the lid 2, which are positioned head to tail, the inner walls of the attachment strip 15 of the base 1 and of the lid 2 are glued to the outer walls of the second main flap 5 of the lid 2 and of the base 1 respectively.

Figure 7:
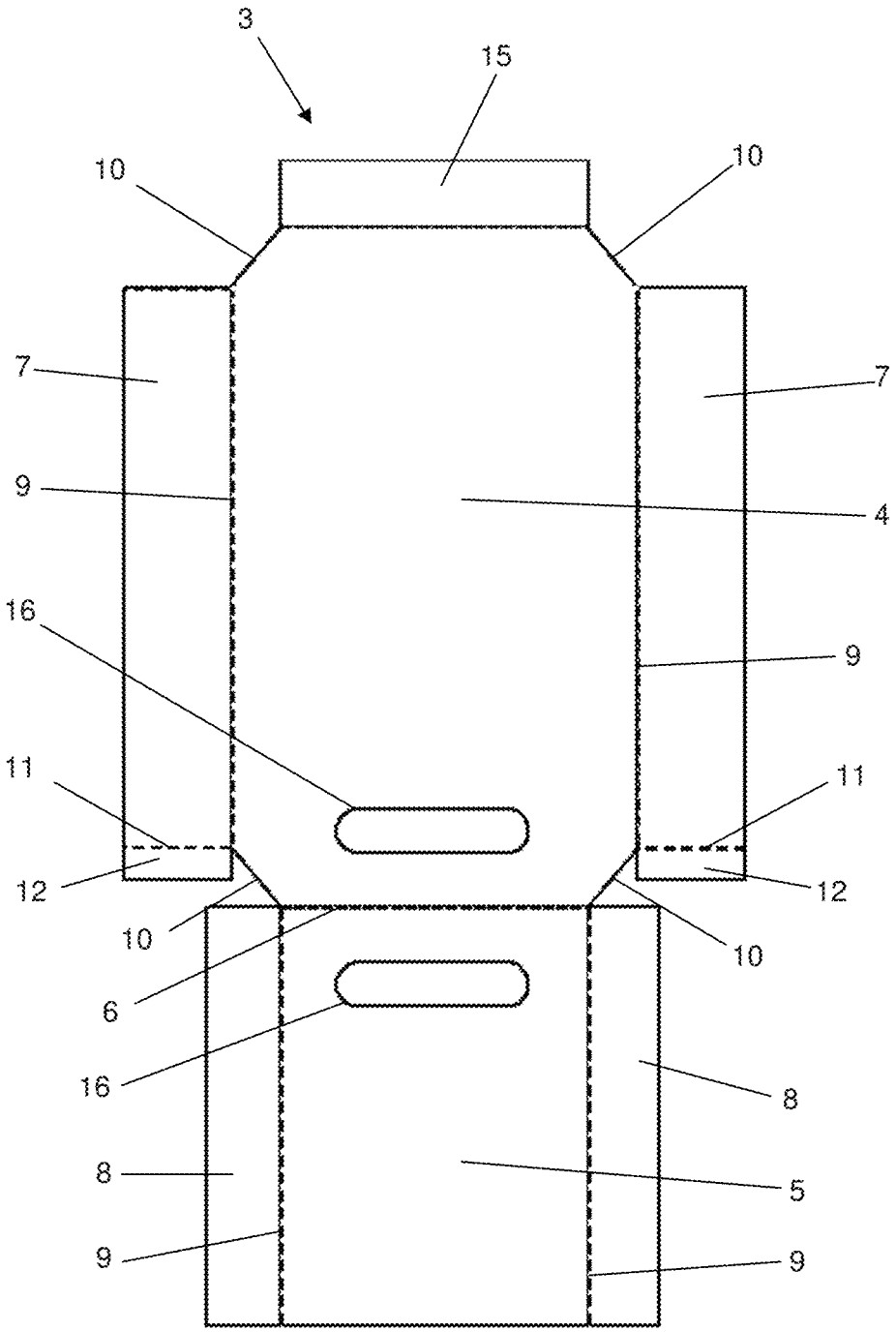
FIG. 7 is a top view of a cutout for producing a second embodiment version of the packaging according to the invention shown in FIGS. 8 and 9.
Figure 8:
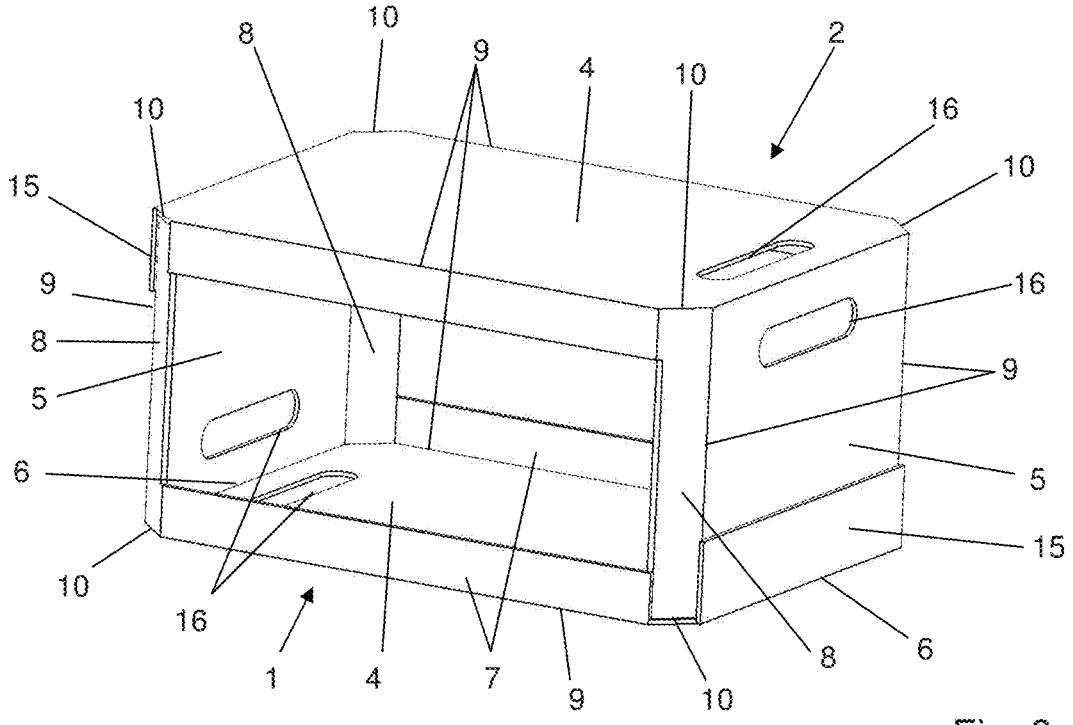
FIG. 8 is a perspective view of a second embodiment of the packaging according to the invention.
Figure 9:
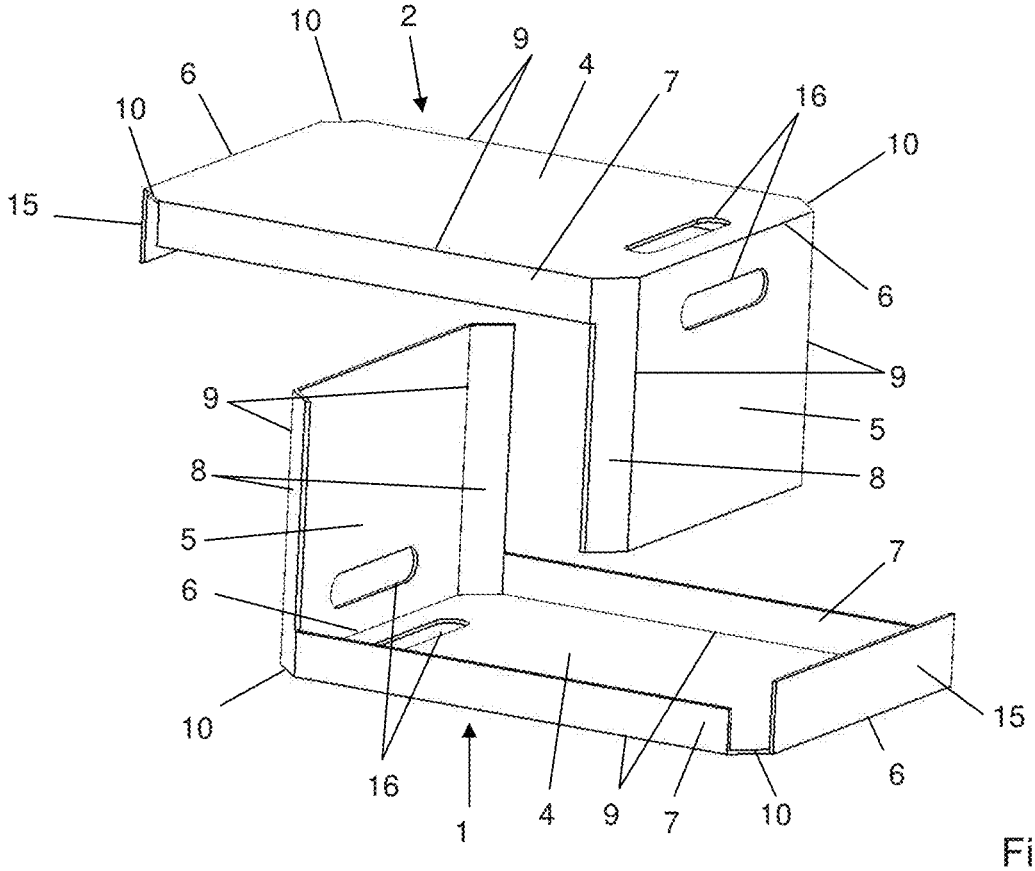
FIG. 9 is a perspective and exploded view of the second embodiment of the packaging shown in FIG. 8.

According to a second embodiment, and with reference to FIGS. 7 to 9, as previously described the packaging comprises two elements, a first element forming the base 1 of the packaging and a second element forming the lid 2 of the packaging, said elements forming the base 1 and the lid 2 having a general L-shape, and being obtained from two identical cutouts 3 shown in FIG. 4. The base 1 and the lid are secured by head-to-tail gluing to form a packaging that is substantially parallelepiped.

Each cutout 3 forming respectively the base 1 and the lid 2 of the packaging comprises two main flaps, a first main flap 4 forming the bottom of the packaging and the top of the packaging respectively, and a second main flap 5 forming the side walls of the packaging, said main flaps 4 and 5 being connected by a first fold line 6. The packaging also comprises a set of lateral tabs 7 and 8 respectively, arranged on either side of said main flaps 4 and 5 respectively, and connected to said main flaps 4 and 5 by second fold lines 9 perpendicular to the first fold line 6. The first main flap 4 is of rectangular shape and the four corners thereof are chamfered, thereby forming chamfered corners 10, and the second main flap 5 is of rectangular shape, the long side of which is shorter than the long side of the first main flap 4.

Furthermore, the lateral tabs 7 of the first main flap 4 have a length that is longer than the long side of said first flap 4, between two chamfered corners. In this specific embodiment example, the lateral tabs 7 of the first main flap 4 have a width that is shorter than the length of the second main flap 5, more specifically the lateral tabs 7 of the first main flap 4 have a width that is substantially equal to the length of the chamfered corners 10 of the first main flap 4, so that the products are visible on the longitudinal sides of the packaging. Moreover, the lateral tabs 7 of the first main flap 4 protrude from the chamfered corners 10 towards the second main flap 5 and each lateral tab 7 of the first main flap 4 comprises a third fold line 11, parallel to the first fold line 6 and extending in the part protruding from the chamfered corner 10, at the junction between the longitudinal side of the first main flap 4 and the chamfered corner, to form a strip 12 intended to be secured by gluing, for example, on the inner face of the tabs 8 of the second main flap 5. The lateral tabs 8 of the second main flap 4 extend over the entire length of the long side of said second main flap 5, and said lateral tabs 8 have a width that is equal to the length of the chamfered corners 10 of the first main flap 4.

The lateral tabs 7, once they are folded perpendicular to the main flap 4, form longitudinal walls of the packaging and the lateral tabs 8, once they are folded perpendicular to the main flap 5, form the chamfered panels to produce an "eight-panel" packaging that features great mechanical resistance, in particular under vertical compression.

In order the secure the lid 2 to the base 1 or inversely, the first main flap 4 of each cutout 3 is ended by an attachment strip 15, substantially rectangular and extending between the two chamfered corners 10 of the end of said main flap, connected to said first main flap 4 by a fold line 6. To assemble the base 1 and the lid 2, which are positioned head to tail, the inner walls of the attachment strip 15 of the base 1 and of the lid 2 are glued to the outer walls of the second main flap 5 of the lid 2 and of the base 1 respectively.

The packaging differs from that described above in that the cutouts 3 forming the base 1 and the lid 2 comprise two oblong cavities 16, a first oblong cavity 16 provided in the first main flap 4, and a second oblong cavity 16 provided in the second main flap 5, said oblong cavities 16 extending symmetrically on either side of the first fold line 6 connecting the first main flap 4 to the second main flap 5 and symmetrically on either side of the longitudinal axis of symmetry of the cutout 3. These oblong cavities 16 advantageously form gripping handles, thereby facilitating the handling of the packaging boxes.

Naturally, it should be noted that only the first main flap and/or the second main flap of at least one of the elements can comprise an oblong cavity 16 forming a gripping handle without departing from the scope of the invention.

Figure 10:
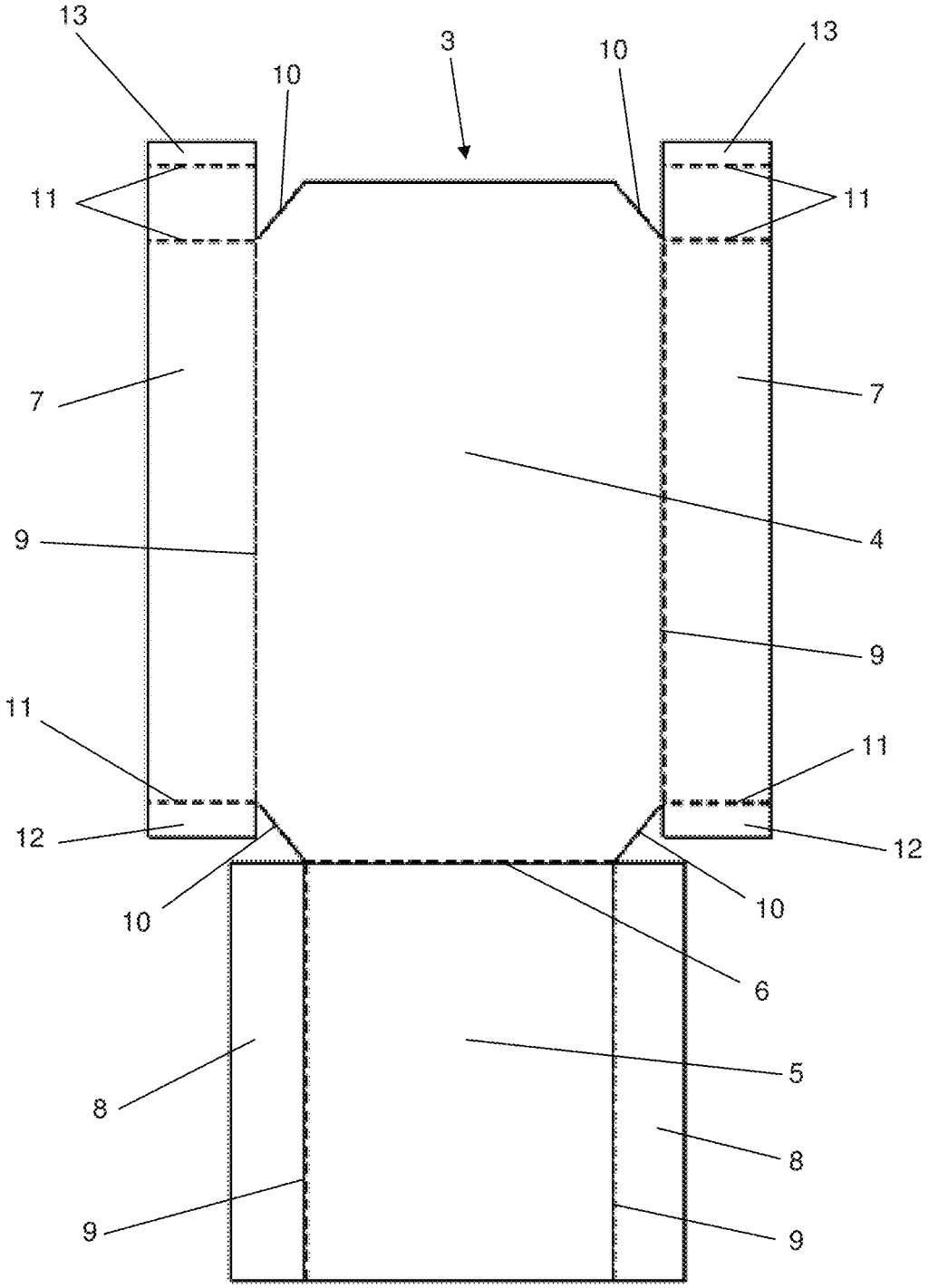
FIG. 10 is a top view of a cutout for producing a third embodiment version of the packaging according to the invention shown in FIGS. 11 and 12.
Figure 11:
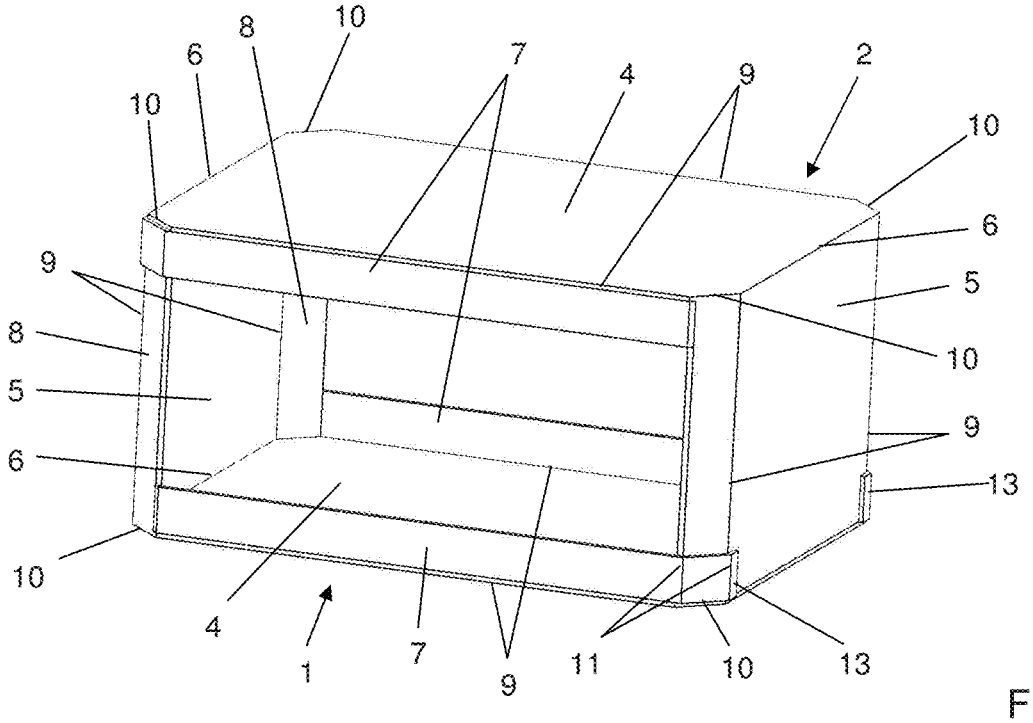
FIG. 11 is a perspective view of a third embodiment of the packaging according to the invention.
Figure 12:
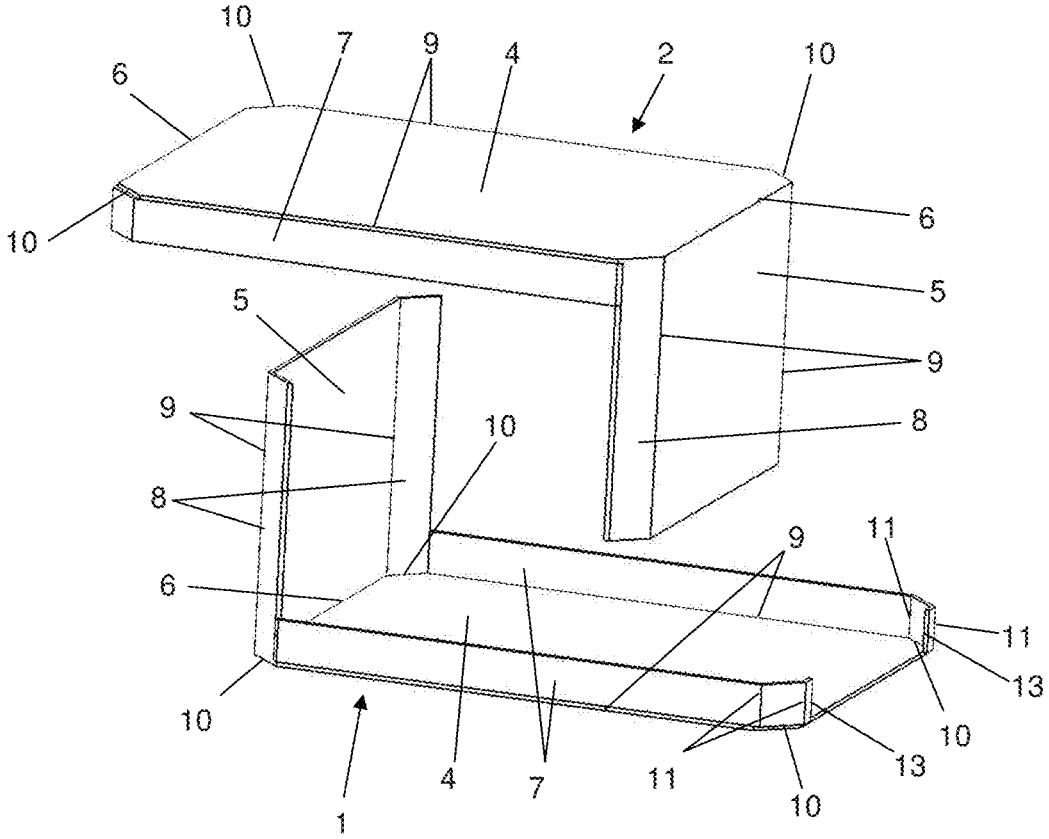
FIG. 12 is a perspective and exploded view of the third embodiment of the packaging shown in FIG. 11, FIGS. 13 and 14 are top views of cutouts for producing a fourth embodiment version of the packaging according to the invention shown in FIGS. 15 and 16.
Figure 13:
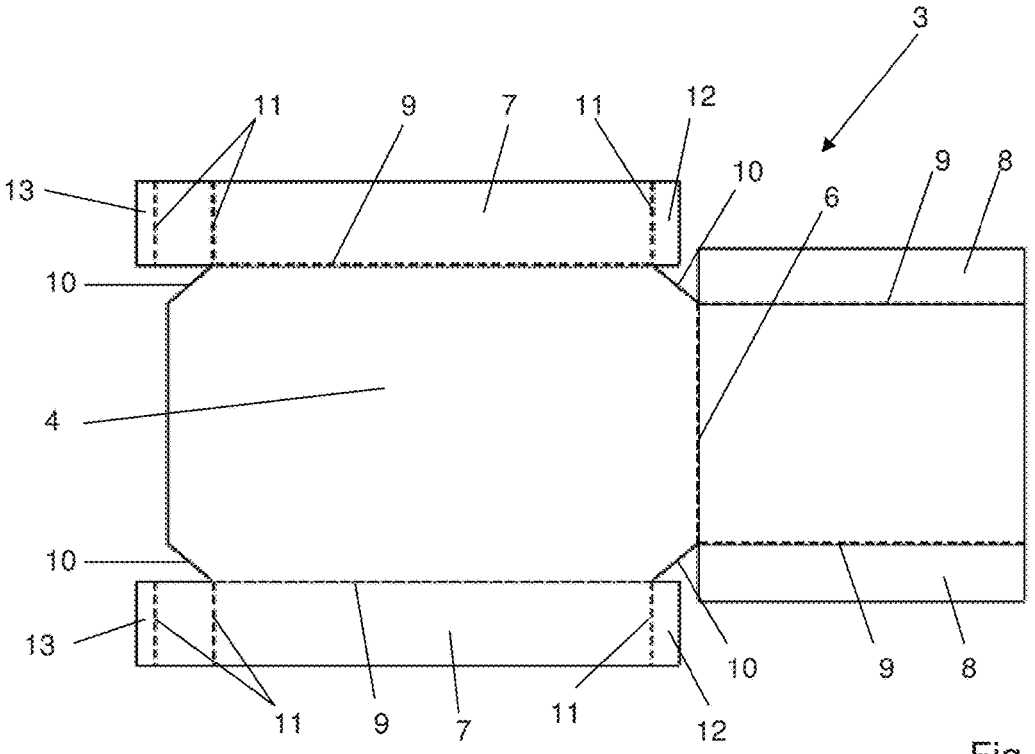
Figure 14:
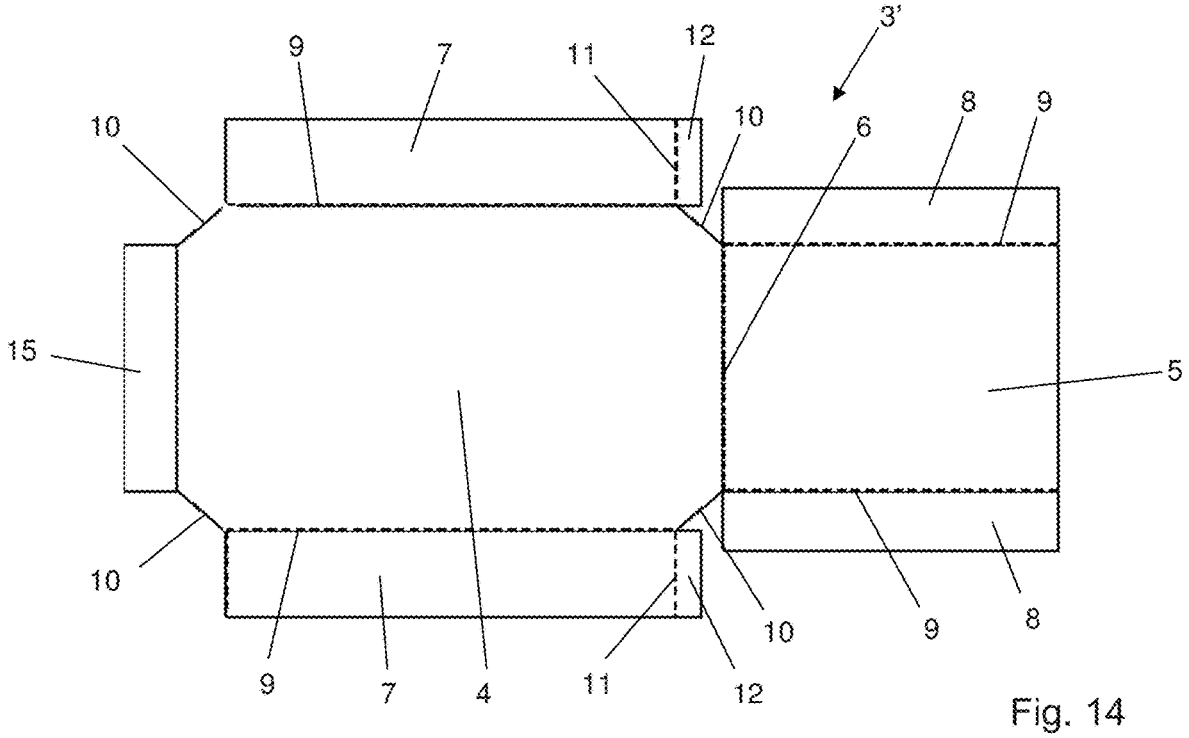
Figure 15:
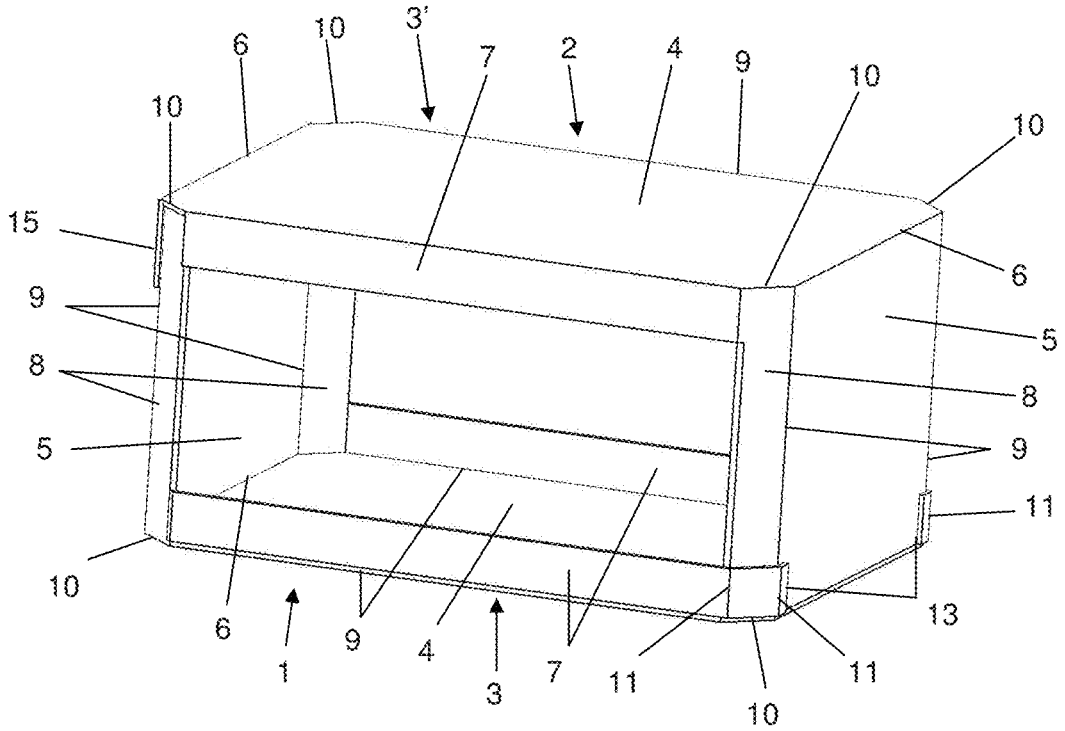
FIG. 15 is a perspective view of a fourth embodiment of the packaging according to the invention.
Figure 16:
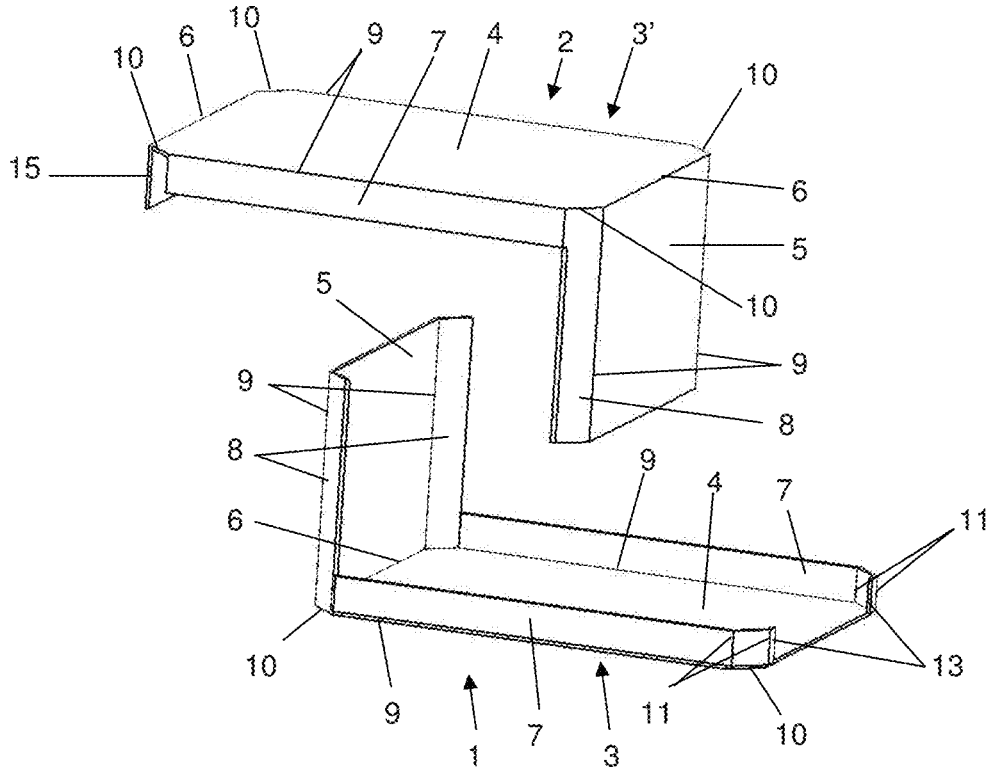
FIG. 16 is a perspective and exploded view of the fourth embodiment of the packaging shown in FIG. 15, FIGS. 17 and 18 are perspective views and perspective exploded views respectively of a fifth embodiment version of the packaging according to the invention.

According to a third embodiment, and with reference to FIGS. 10 to 12, the packaging according to the invention comprises two elements, i.e. a first element forming the base 1 of the packaging and a second element forming the lid 2 of the packaging, said elements forming the base 1 and the lid 2 having a general L-shape, and being obtained from two identical cutouts 3 shown in FIG. 7. The base 1 and the lid are secured by head-to-tail gluing to form a packaging that is substantially parallelepiped.

Each cutout 3 forming respectively the base 1 and the lid 2 of the packaging comprises two main flaps, a first main flap 4 forming the bottom of the packaging and the top of the packaging respectively, and a second main flap 5 forming the side walls of the packaging, said main flaps 4 and 5 being connected by a first fold line 6. The packaging also comprises a set of lateral tabs 7 and 8 respectively, arranged on either side of said main flaps 4 and 5 respectively, and connected to said main flaps 4 and 5 by second fold lines 9 perpendicular to the first fold line 6. The first main flap 4 is of rectangular shape and the four corners thereof are chamfered, thereby forming chamfered corners 10, and the second main flap 5 is of rectangular shape, the long side of which is shorter than the long side of the first main flap 4.

Furthermore, the lateral tabs 7 of the first main flap 4 have a length that is longer than the long side of said first flap 4, between two chamfered corners. In this specific embodiment example, the lateral tabs 7 of the first main flap 4 have a width that is shorter than the length of the second main flap 5, more specifically the lateral tabs 7 of the first main flap 4 have a width that is substantially equal to the length of the chamfered corners 10 of the first main flap 4, so that the products are visible on the longitudinal sides of the packaging. Moreover, the lateral tabs 7 of the first main flap 4 protrude from the chamfered corners 10 towards the second main flap 5 and each lateral tab 7 of the first main flap 4 comprises a third fold line 11, parallel to the first fold line 6 and extending in the part protruding from the chamfered corner 10, at the junction between the longitudinal side of the first main flap 4 and the chamfered corner, to form a strip 12 intended to be secured by gluing, for example, on the inner face of the tabs 8 of the second main flap 5. The lateral tabs 7 of the first main flap 4 protrude from the chamfered corners 10 in the direction opposite that of the second main flap 5. Each lateral tab 7 of the first main flap 4 comprises two third fold lines 11 that extend in the part protruding from the chamfered corner 10 in the direction opposite that of the second main flap 5, the third fold lines 11 extending to the angles of the chamfered corners and the distance between the two fold lines 11 being equal to the length of the chamfered corner 10, to form attachment strips 13. These attachment strips 13 allow securing the lid 2 to the base 1 or inversely. To assemble the base 1 and the lid 2, which are positioned head to tail, the inner walls of the attachment strips 13 of the base 1 and of the lid 2 are glued to the outer walls of the second main flap 5 of the lid 2 and of the base 1 respectively.

Moreover, said lateral tabs 8 of the second main flap 4 extend over the entire length of the long side of said second main flap 5, and said lateral tabs 8 have a width that is equal to the length of the chamfered corners 10 of the first main flap 4.

According to a fourth embodiment of the packaging according to the invention, and with reference to FIGS. 13 to 16, the packaging comprises two elements, a first element forming the base 1 of the packaging and a second element forming the lid 2 of the packaging, said elements forming the base 1 and the lid 2 having a general L-shape, and being obtained from two different cutouts 3 and 3' respectively, shown in FIGS. 10 and 11 respectively. The 30*o* base 1 and the lid 2 are secured by head-to-tail gluing to form a packaging that is substantially parallelepiped.

The cutout 3 forming the base 1 of the packaging comprises two main flaps, a first main flap 4 forming the bottom of the packaging and a second main flap 5 forming a side wall of the packaging, said main flaps 4 and 5 being connected by a first fold line 6. The packaging also comprises a set of lateral tabs 7 and 8 respectively, arranged on either side of said main flaps 4 and 5 respectively, and connected to said main flaps 4 and 5 by second fold lines 9 perpendicular to the first fold line 6. The first main flap 4 is of rectangular shape and the four corners thereof are chamfered, thereby forming chamfered corners 10, and the second main flap 5 is of rectangular shape, the long side of which is shorter than the long side of the first main flap 4.

Furthermore, the lateral tabs 7 of the first main flap 4 have a length that is longer than the long side of said first flap 4, between two chamfered corners. In this specific embodiment example, the lateral tabs 7 of the first main flap 4 have a width that is shorter than the length of the second main flap 5, more specifically the lateral tabs 7 of the first main flap 4 have a width that is substantially equal to the length of the chamfered corners 10 of the first main flap 4, so that the products are visible on the longitudinal sides of the packaging. Moreover, the lateral tabs 7 of the first main flap 4 protrude from the chamfered corners 10 towards the second main flap 5 and each lateral tab 7 of the first main flap 4 comprises a third fold line 11, parallel to the first fold line 6 and extending in the part protruding from the chamfered corner 10, at the junction between the longitudinal side of the first main flap 4 and the chamfered corner, to form a strip 12 intended to be secured by gluing, for example, on the inner face of the tabs 8 of the second main flap 5. The lateral tabs 7 of the first main flap 4 protrude from the chamfered corners 10 in the direction opposite that of the second main flap 5. Each lateral tab 7 of the first main flap 4 comprises two third fold lines 11 that extend in the part protruding from the chamfered corner 10 in the direction opposite that of the second main flap 5, the third fold lines 11 extending to the angles of the chamfered corners and the distance between the two fold lines 11 being equal to the length of the chamfered corner 10, to form attachments strips 13. These attachment strips 13 allow securing the lid 2 to the base 1 or inversely. To assemble the base 1 and the lid 2, which are positioned head to tail, the inner walls of the attachment strips 13 of the base 1 are glued to the outer wall of the second main flap 5 of the lid 2.

Moreover, said lateral tabs 8 of the second main flap 4 extend over the entire length of the long side of said second main flap 5, and said lateral tabs 8 have a width that is equal to the length of the chamfered corners 10 of the first main flap 4.

The cutout 3' forming the lid 2 of the packaging comprises two main flaps, a first main flap 4 forming the top of the packaging and a second main flap 5 forming a side wall of the packaging, said main flaps 4 and 5 being connected by a first fold line 6. The packaging also comprises a set of lateral tabs 7 and 8 respectively, arranged on either side of said main flaps 4 and 5 respectively, and connected to said main flaps 4 and 5 by second fold lines 9 perpendicular to the first fold line 6. The first main flap 4 is of rectangular shape and the four corners thereof are chamfered, thereby forming chamfered corners 10, and the second main flap 5 is of rectangular shape, the long side of which is shorter than the long side of the first main flap 4.

Furthermore, the lateral tabs 7 of the first main flap 4 have a length that is longer than the long side of said first flap 4, between two chamfered corners. In this specific embodiment example, the lateral tabs 7 of the first main flap 4 have a width that is shorter than the length of the second main flap 5, more specifically the lateral tabs 7 of the first main flap 4 have a width that is substantially equal to the length of the chamfered corners 10 of the first main flap 4, so that the products are visible on the longitudinal sides of the packaging. Moreover, the lateral tabs 7 of the first main flap 4 protrude from the chamfered corners 10 towards the second main flap 5 and each lateral tab 7 of the first main flap 4 comprises a third fold line 11, parallel to the first fold line 6 and extending in the part protruding from the chamfered corner 10, at the junction between the longitudinal side of the first main flap 4 and the chamfered corner, to form a strip 12 intended to be secured by gluing, for example, on the inner face of the tabs 8 of the second main flap 5. The lateral tabs 8 of the second main flap 4 extend over the entire length of the long side of said second main flap 5, and said lateral tabs 8 have a width that is equal to the length of the chamfered corners 10 of the first main flap 4.

The lateral tabs 7, once they are folded perpendicular to the main flap 4, form longitudinal walls of the packaging and the lateral tabs 8, once they are folded perpendicular to the main flap 5, form the chamfered panels to produce an "eight-panel" packaging that features great mechanical resistance, in particular under vertical compression.

In order the secure the lid 2 to the base 1, the first main flap 4 of the cutout 3' is ended by an attachment strip 15, substantially rectangular and extending between the two chamfered corners 10 of the end of said main flap 4, connected to said first main flap 4 by a fold line 6. To assemble the base 1 and the lid 2, which are positioned head to tail, the inner wall of the attachment strip 15 of the lid 2 is glued to the outer wall of the second main flap 5 of the base 1.

Figure 17:
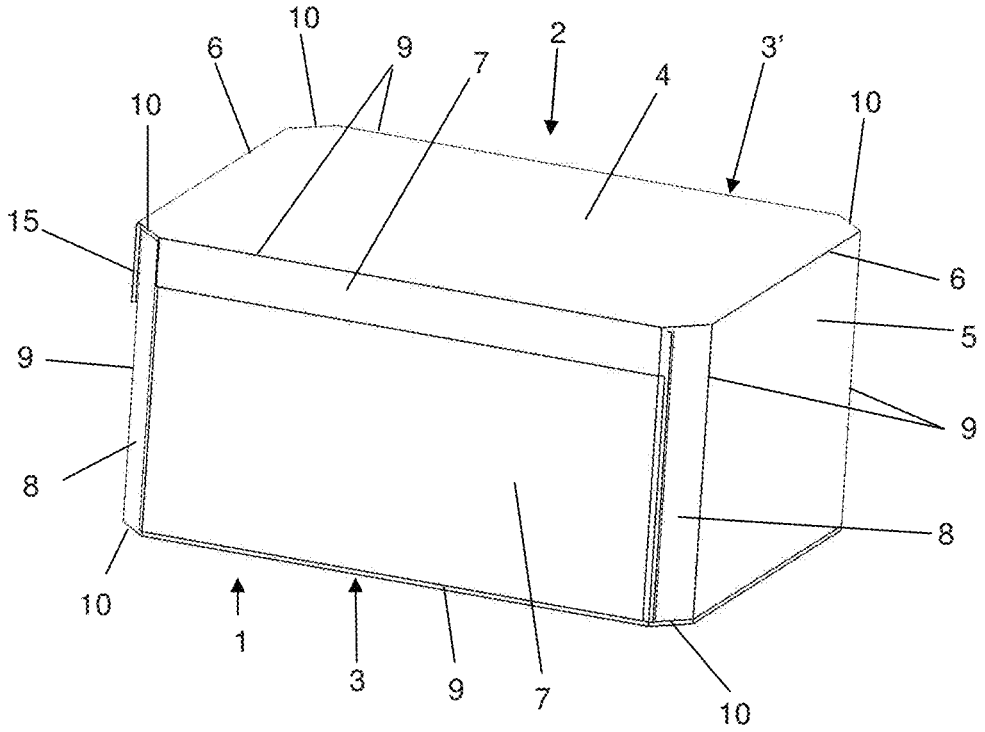
Figure 18:
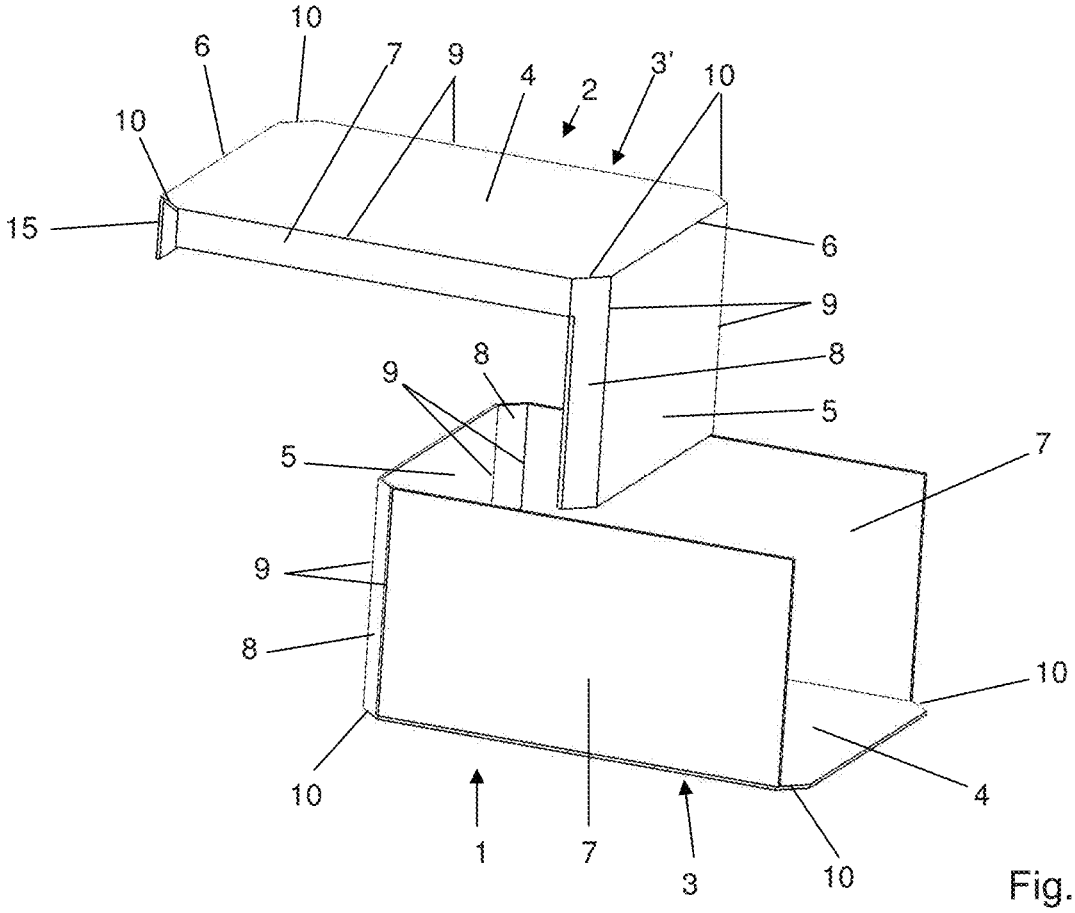

According to a fifth embodiment, and with reference to FIGS. 17 to 18, the packaging comprises two elements, a first element forming the base 1 of the packaging and a second element forming the lid 2 of the packaging, said elements forming the base 1 and the lid 2 having a general L-shape, and being obtained from two different cutouts 3 and 3' respectively. The base 1 and the lid 2 are secured by head-to-tail gluing to form a packaging that is substantially parallelepiped.

The cutout 3 forming the base 1 of the packaging comprises two main flaps, a first main flap 4 forming the bottom of the packaging and a second main flap 5 forming a side wall of the packaging, said main flaps 4 and 5 being connected by a first fold line 6. The packaging also comprises a set of lateral tabs 7 and 8 respectively, arranged on either side of said main flaps 4 and 5 respectively, and connected to said main flaps 4 and 5 by second fold lines 9 perpendicular to the first fold line 6. The first main flap 4 is of rectangular shape and the four corners thereof are chamfered, thereby forming chamfered corners 10, and the second main flap 5 is of rectangular shape, the long side of which is shorter than the long side of the first main flap 4.

Furthermore, the lateral tabs 7 of the first main flap 4 have a length that is longer than the long side of said first flap 4, between two chamfered corners. In this specific embodiment example, the lateral tabs 7 of the first main flap 4 have a width that is equal to the length of the second main flap 5 so that the products are not visible on the longitudinal sides of the packaging. Moreover, the lateral tabs 7 of the first main flap 4 protrude from the chamfered corners 10 towards the second main flap 5 and each lateral tab 7 of the first main flap 4 comprises a third fold line 11, parallel to the first fold line 6 and extending in the part protruding from the chamfered corner 10, at the junction between the longitudinal side of the first main flap 4 and the chamfered corner, to form a strip 12 intended to be secured by gluing, for example, on the inner face of the tabs 8 of the second main flap 5. The lateral tabs 8 of the second main flap 5 extend over the entire length of the long side of said second main flap 5 and said lateral tabs 8 have a width that is equal to the length of the chamfered corners 10 of the first main flap 4.

The lateral tabs 7, once they are folded perpendicular to the main flap 4, form longitudinal walls of the packaging and the lateral tabs 8, once they are folded perpendicular to the main flap 5, form the chamfered panels to produce an "eight-panel" packaging that features great mechanical resistance, in particular under vertical compression.

The cutout 3' forming the lid 2 of the packaging comprises two main flaps, a first main flap 4 forming the top of the packaging and a second main flap 5 forming a side wall of the packaging, said main flaps 4 and 5 being connected by a first fold line 6. The packaging also comprises a set of lateral tabs 7 and 8 respectively, arranged on either side of said main flaps 4 and 5 respectively, and connected to said main flaps 4 and 5 by second fold lines 9 perpendicular to the first fold line 6. The first main flap 4 is of rectangular shape and the four corners thereof are chamfered, thereby forming chamfered corners 10, and the second main flap 5 is of rectangular shape, the long side of which is shorter than the long side of the first main flap 4.

Furthermore, the lateral tabs 7 of the first main flap 4 have a length that is longer than the long side of said first flap 4, between two chamfered corners. In this specific embodiment example, the lateral tabs 7 of the first main flap 4 have a width that is shorter than the length of the second main flap 5, more specifically the lateral tabs 7 of the first main flap 4 have a width that is substantially equal to the length of the chamfered corners 10 of the first main flap 4, so that the products are visible on the longitudinal sides of the packaging. Moreover, the lateral tabs 7 of the first main flap 4 protrude from the chamfered corners 10 towards the second main flap 5 and each lateral tab 7 of the first main flap 4 comprises a third fold line 11, parallel to the first fold line 6 and extending in the part protruding from the chamfered corner, at the junction between the longitudinal side of the first main flap 4 and the chamfered corner, to form a strip 12 intended to be secured by gluing, for example, on the inner face of the tabs 8 of the second main flap 5. The lateral tabs 8 of the second main flap 4 extend over the entire length of the long side of said second main flap 5, and said lateral tabs 8 have a width that is equal to the length of the chamfered corners 10 of the first main flap 4.

The lateral tabs 7, once they are folded perpendicular to the main flap 4, form longitudinal walls of the packaging and the lateral tabs 8, once they are folded perpendicular to the main flap 5, form the chamfered panels to produce an "eight-panel" packaging that features great mechanical resistance, in particular under vertical compression.

In order the secure the lid 2 to the base 1, the first main flap 4 of the cutout 3' is ended by an attachment strip 15, substantially rectangular and extending between the two chamfered corners 10 of the end of said main flap 4, connected to said first main flap 4 by a fold line 6. To assemble the base 1 and the lid 2, which are positioned head to tail, the inner wall of the attachment strip 15 of the lid 2 is glued to the outer wall of the second main flap 5 of the base 1.

Figure 19:
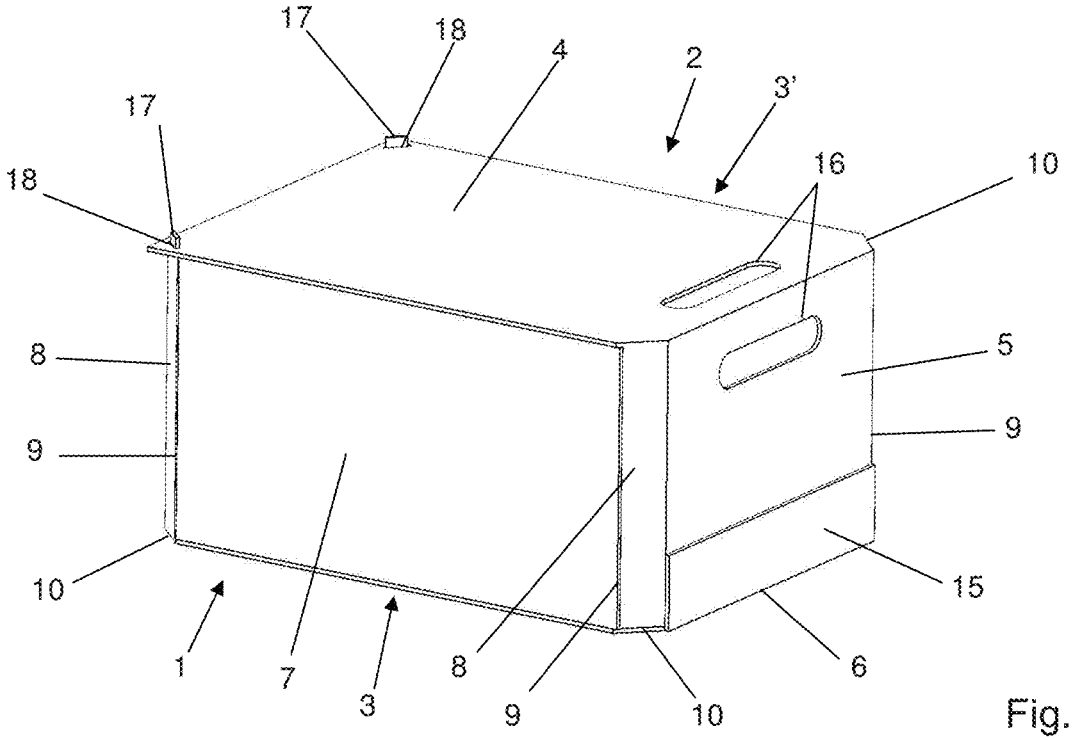
FIGS. 19 and 20 are perspective views and perspective exploded views respectively of a sixth embodiment version of the packaging according to the invention.
Figure 20:
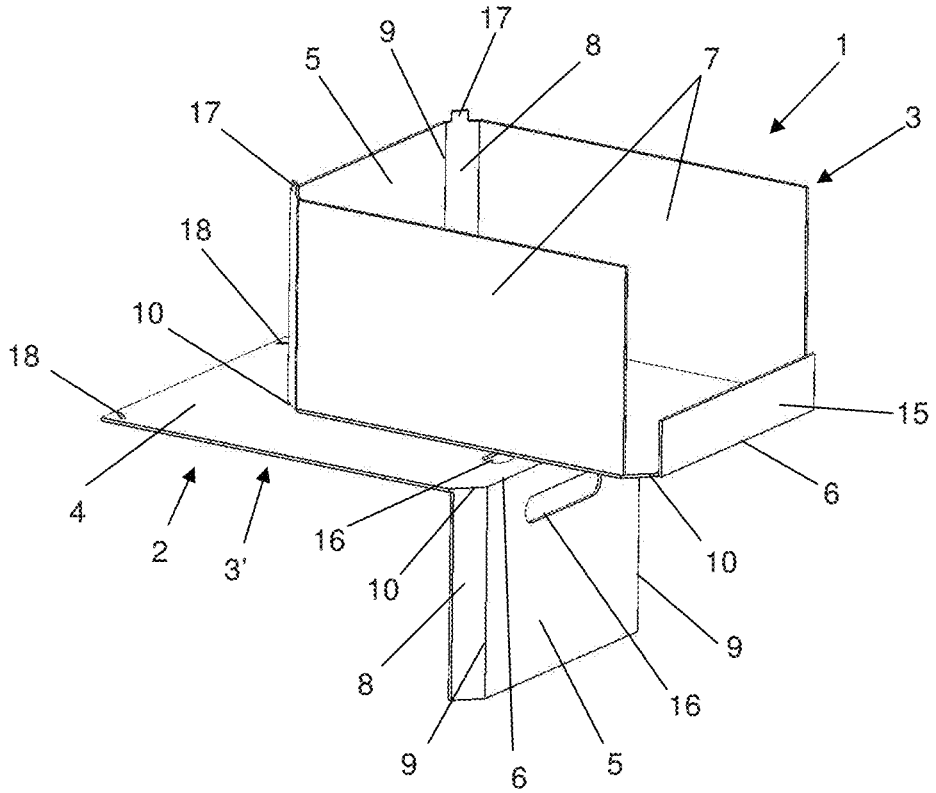

According to a sixth embodiment of the packaging according to the invention, and with reference to FIGS. 19 and 20, the packaging comprises two elements, a first element forming the base 1 of the packaging and a second element forming the lid 2 of the packaging, said elements forming the base 1 and the lid 2 having a general L-shape, and being obtained from two different cutouts 3 and 3' respectively. The base 1 and the lid 2 are secured by head-to-tail gluing to form a packaging that is substantially parallelepiped.

The cutout 3 forming the base 1 of the packaging comprises two main flaps, a first main flap 4 forming the bottom of the packaging and a second main flap 5 forming a side wall of the packaging, said main flaps 4 and 5 being connected by a first fold line 6. The packaging also comprises a set of lateral tabs 7 and 8 respectively, arranged on either side of said main flaps 4 and 5 respectively, and connected to said main flaps 4 and 5 by second fold lines 9 perpendicular to the first fold line 6. The first main flap 4 is of rectangular shape and the four corners thereof are chamfered, thereby forming chamfered corners 10, and the second main flap 5 is of rectangular shape, the long side of which is shorter than the long side of the first main flap 4.

Furthermore, the lateral tabs 7 of the first main flap 4 have a length that is longer than the long side of said first flap 4, between two chamfered corners. In this specific embodiment example, the lateral tabs 7 of the first main flap 4 have a width that is equal to the length of the second main flap 5 so that the products are not visible on the longitudinal sides of the packaging. Moreover, the lateral tabs 7 of the first main flap 4 protrude from the chamfered corners 10 towards the second main flap 5 and each lateral tab 7 of the first main flap 4 comprises a third fold line 11, parallel to the first fold line 6 and extending in the part protruding from the chamfered corner 10, at the junction between the longitudinal side of the first main flap 4 and the chamfered corner, to form a strip 12 intended to be secured by gluing, for example, on the inner face of the tabs 8 of the second main flap 5. The lateral tabs 8 of the second main flap 4 extend over the entire length of the long side of said second main flap 5, and said lateral tabs 8 have a width that is equal to the length of the chamfered corners 10 of the first main flap 4.

The lateral tabs 7, once they are folded perpendicular to the main flap 4, form longitudinal walls of the packaging and the lateral tabs 8, once they are folded perpendicular to the main flap 5, form the chamfered panels to produce an "eight-panel" packaging that features great mechanical resistance, in particular under vertical compression.

The cutout 3' forming the lid 2 of the packaging comprises two main flaps, a first main flap 4 forming the top of the packaging and a second main flap 5 forming a side wall of the packaging, said main flaps 4 and 5 being connected by a first fold line 6. The packaging also comprises lateral tabs 8, arranged on either side of said main flap 5, and connected to said main flap 5 by second fold lines 9 perpendicular to the first fold line 6. The first main flap 4 is of rectangular shape and only two corners thereof, the corners extending perpendicular to the second main flap 5, are chamfered, thereby forming chamfered corners 10, the two other corners being straight, and the second main flap 5 is of rectangular shape, the long side of which is shorter than the long side of the first main flap 4.

In order to secure the lid 2 to the base 1, the lateral sides of the lateral tabs 8 of the second main flap 5 of the base 1, opposite the first main flap 4 of the cutout 3 comprise a tenon 17, in the form of a rectangular strip, intended to be introduced in a mortise 18, in the form of an oblique slot, provided in the first main flap 4, at the level of the corners opposite the second main flap 5 of the cutout 3' forming the lid 2.

Moreover, the cutout 3' forming the lid 2 comprises two oblong cavities 16, a first oblong cavity 16 provided in the first main flap 4, and a second oblong cavity 16 provided in the second main flap 5, said oblong cavities 16 extending symmetrically on either side of the first fold line 6 connecting the first main flap 4 to the second main flap 5 and symmetrically on either side of the longitudinal axis of symmetry of the cutout 3'. These oblong cavities 16 advantageously form gripping handles.

Figure 21:
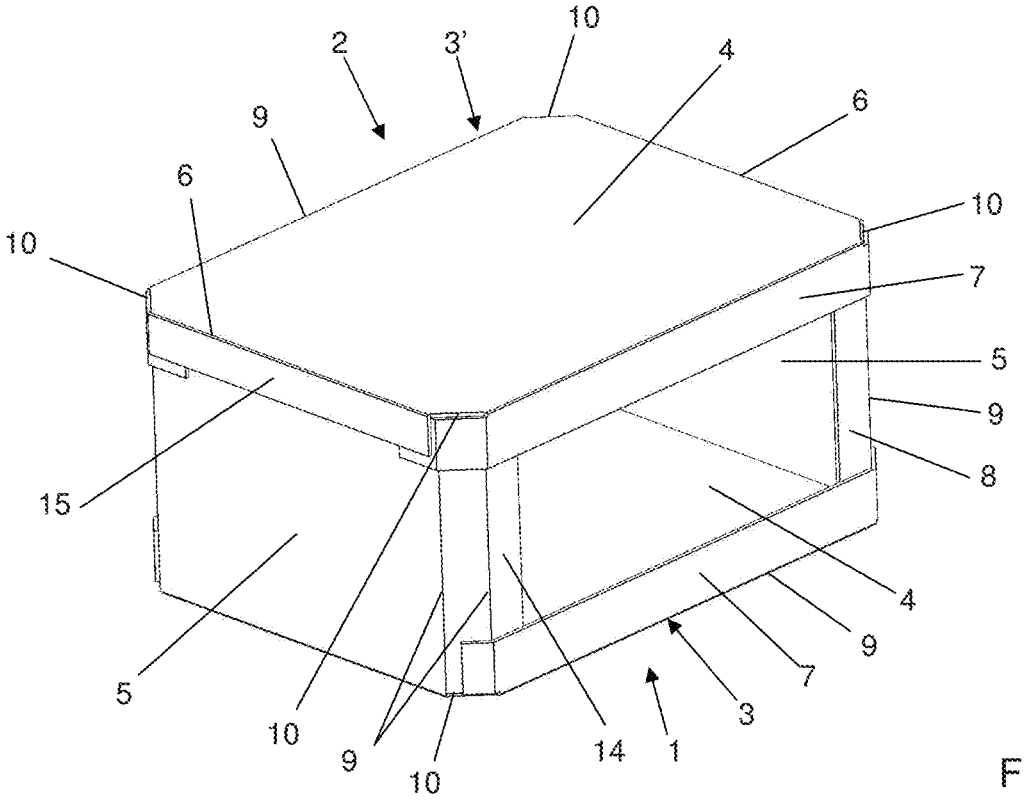
FIGS. 21 and 22 are perspective views and perspective exploded views respectively of a seventh embodiment version of the packaging according to the invention.
Figure 22:
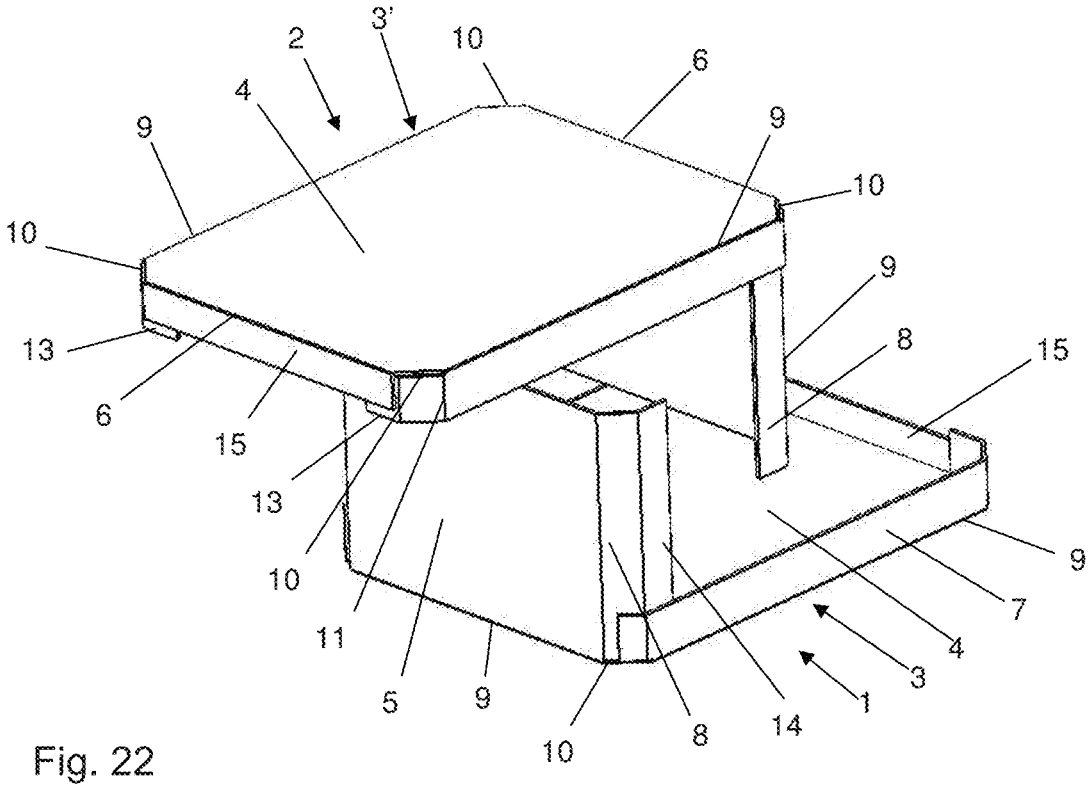

According to a seventh embodiment of the packaging according to the invention, and with reference to FIGS. 21 and 22, the packaging according to the invention comprises two elements, i.e. a first element forming the base 1 of the packaging and a second element forming the lid 2 of the packaging, said elements forming the base 1 and the lid 2 having a general L-shape, and being obtained from two identical cutouts 3. The base 1 and the lid 2 are secured by head-to-tail gluing to form a packaging that is substantially parallelepiped.

The cutout 3 forming the base 1 and the lid 2 of the packaging comprises two main flaps, a first main flap 4 forming the bottom of the packaging and a second main flap 5 forming a side wall of the packaging, said main flaps 4 and 5 being connected by a first fold line 6. The packaging also comprises a set of lateral tabs 7 and 8 respectively, arranged on either side of said main flaps 4 and 5 respectively, and connected to said main flaps 4 and 5 by second fold lines 9 perpendicular to the first fold line 6. The first main flap 4 is of rectangular shape and the four corners thereof are chamfered, thereby forming chamfered corners 10, and the second main flap 5 is of rectangular shape, the long side of which is shorter than the long side of the first main flap 4.

Furthermore, the lateral tabs 7 of the first main flap 4 have a length that is longer than the long side of said first flap 4, between two chamfered corners. In this specific embodiment example, the lateral tabs 7 of the first main flap 4 have a width that is shorter than the length of the second main flap 5, more specifically the lateral tabs 7 of the first main flap 4 have a width that is substantially equal to the length of the chamfered corners 10 of the first main flap 4, so that the products are visible on the longitudinal sides of the packaging. Moreover, the lateral tabs 7 of the first main flap 4 protrude from the chamfered corners 10 towards the second main flap 5 and each lateral tab 7 of the first main flap 4 comprises a third fold line 11, parallel to the first fold line 6 and extending in the part protruding from the chamfered corner 10, at the junction between the longitudinal side of the first main flap 4 and the chamfered corner, to form a strip 12 intended to be secured by gluing, for example, on the inner face of the tabs 8 of the second main flap 5. The lateral tabs 7 of the first main flap 4 protrude from the chamfered corners 10 in the direction opposite that of the second main flap 5. Each lateral tab 7 of the first main flap 4 comprises two third fold lines 11 that extend in the part protruding from the chamfered corner 10 in the direction opposite that of the second main flap 5, the third fold lines 11 extending to the angles of the chamfered corners and the distance between the two fold lines 11 being equal to the length of the chamfered corner 10, to form attachments strips 13. To assemble the base 1 and the lid 2, which are positioned head to tail, the inner walls of the attachment strips 13 of the base 1 and of the lid 2 are glued to the outer walls of the second main flap 5 of the lid 2 and of the base 1 respectively.

Moreover, said lateral tabs 8 of the second main flap 4 extend over the entire length of the long side of said second main flap 5, and said lateral tabs 8 have a width that is equal to the length of the chamfered corners 10 of the first main flap 4.

To rigidify the packaging, the cutout 3 comprises second lateral tabs 14 connected to the first lateral tabs 8 of the second main flap 5 by second fold lines 9, the width of said second lateral tabs 14 being substantially equal to the width of the first lateral tabs 7 in this specific embodiment example.

Furthermore, the first main flap 4 of the cutout 3 is ended by an attachment strip 15, substantially rectangular and extending between the two chamfered corners 10 of the end of said main flap, connected to said first main flap 4 by a fold line 6. The width of these attachment strips 15 is smaller than the width of the lateral tabs 7. To assemble the base 1 and the lid 2, which are positioned head to tail, the inner walls of the attachment strip 15 of the base 1 and of the lid 2 are glued to the outer walls of the second main flap 5 of the lid 2 and of the base 1 respectively.

Naturally, the chamfered corners 10 of the cutouts 3 and 3' of the examples described above can be convex without departing from the scope of the invention.

Various machines to form and fill the packaging boxes can be provided.

A first device to form and fill the packaging boxes according to the invention comprises a first "forming" machine that forms the base of the packaging from first cutouts stored vertically or horizontally in a store by means of a lateral or vertical motion mandrel, said mandrel providing the L-shape to the base of the packaging, and a second "forming" machine that forms the lid of the packaging from second cutouts stored horizontally in a second store by means of a second vertical mandrel, said second vertical mandrel providing the L-shape to the lid of the packaging and maintaining the lid on the base during gluing operations.

A second device comprises a first store of first cutouts arranged horizontally or vertically, a second store of second cutouts stored horizontally or vertically, the gluing means enabling to deposit spots or beads of glue, the glue being hot-melt adhesive or cold glue, on the first cutout, and a pressing device performing the gluing of the second cutout on the first cutout and comprising a vertical motion press for the forming of the packaging comprising the base and the lid previously glued to one another.

A third device to form and fill packaging boxes according to the invention comprises a first "forming" machine that forms the base of the packaging from the first cutouts and a second "forming" machine that forms the lid of the packaging from the second cutouts, as described previously, with the reversal of the L-shaped cutout and a transfer parallel to the base. Between the two machines, an operator or a machine fills the base with products.

A fourth device comprises a first multi-purpose forming machine that provides an L-shape to a first cutout after extraction from a store of cutouts, around a mandrel, to form the bases, the box packing means of the products, said box packing means being well known to the person skilled in the field and depending on the typology of the products, and a second forming machine that provides an L-shape to a second cutout after extraction from a store of cutouts, to form the lids that are subsequently glued on the bases, all of the above means being secured to a single frame.

Thus, the process for manufacturing packaging according to the invention comprises at least the following steps:

- extraction of a first element constituting the packaging, called base, from a first store of cutouts;
- deposition of glue, be it hot-melt glue or cold glue, on predetermined zones of the base;
- extraction of a second cutout, called lid, from the first store or from a second store;
- placing said second cutout so that it overlaps with the glued zones of the first cutout;
- static or fly pressing of the two cutouts; and
- three-dimensional forming of said cutouts.

Figure 23:
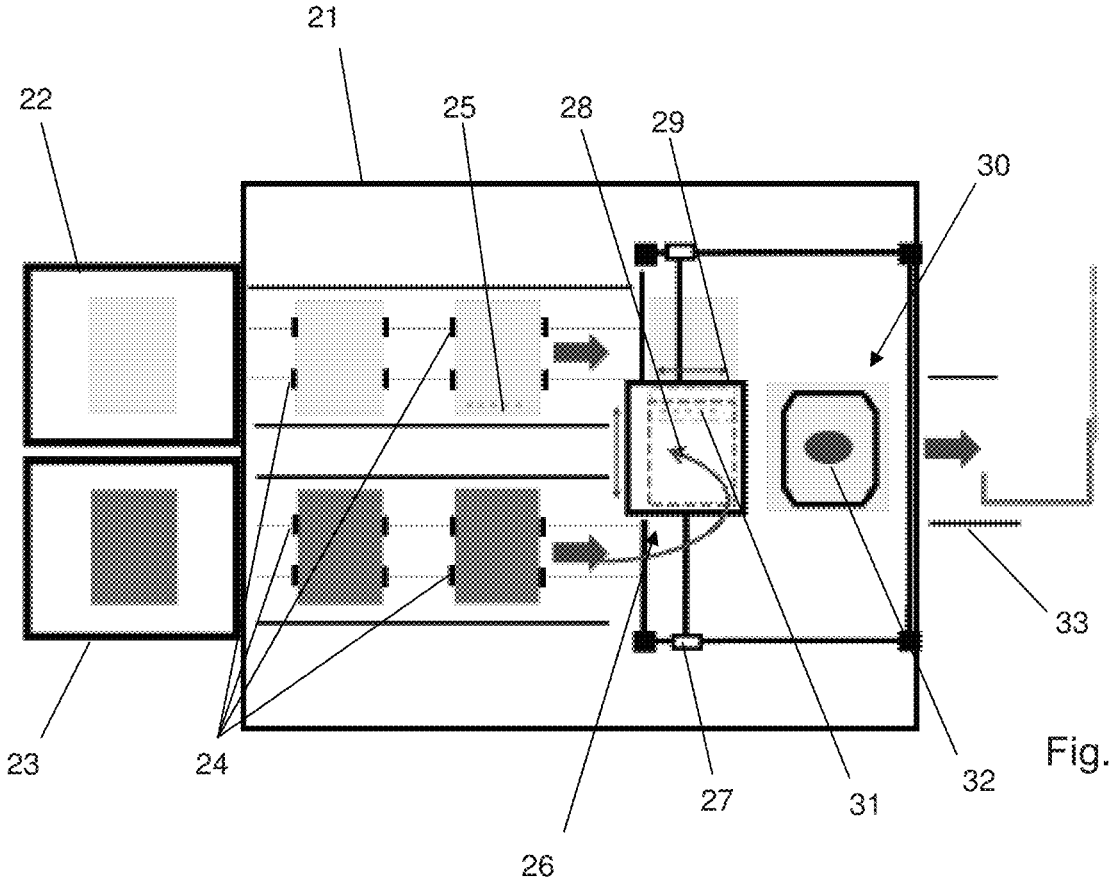
FIG. 23 is a schematic view of a forming machine for producing packaging boxes according to the invention.

In order to implement said process, the device for the manufacturing of a packaging according to the invention, with reference to FIG. 23, preferably comprises a frame 21, conventionally made of struts, crosspieces and stringers, as well as safety side panels. The device also comprises at one of the ends of the frame 21 two cutout stores 22, 23, arranged parallel and side-to-side, said stores 22, 23 having a shape, a volume and an arrangement (horizontal or inclined) that are suited to the storage of cutouts according to the invention. The device also comprises "extraction-transfer" means 24 made, for example, of an articulated arm rotating about a horizontal axis, driven by a motor for example, and the free end of which comprises suction cups with bellows pressing against the faces of the cardboard cutouts of the packaging stored in the stores 22, 23. Thus, the extraction arm 24 takes two cutouts laid flat, simultaneously from the two stores 22, 23, and then performs a horizontal and perfectly positive displacement (continuous guiding and support) of a cutout towards a first hot glue injection system 25. At the following fixed station of the machine, the glue-coated cutout receives the second cutout, which is superimposed in a "grouping" station 26 to press and glue the cardboard cutout serving as base to the cardboard cutout serving as lid. Said grouping station 26 comprises a "superposition" cart 27, a pressing actuator 28 and a depositing actuator 29 depositing the cutouts on the superposition cart 27. Subsequently, the entire cutout thereby formed is transferred in a positive manner, i.e. perfectly guided with respect to a fixed machine reference, towards a forming station 30 comprising a second hot glue injection system 31 performing a rational and non-polluting gluing of all the connecting lugs of the base of the cutouts. This second deposition of glue having been completed, the cutout is pressed in a forming cavity 32 specially adapted to the shape and size of the cardboard, the principle of the pressing operation ensuring perfect squareness of the packaging. Finally, a conventional extraction system evacuates the cutout from the cavity and sends it to an output conveyor 33.

It should be noted that all of the motions are synchronised by mechanical or servo-driven devices that are well known to the person skilled in the field and that various self-setting and tool-changing devices will facilitate the flexibility of the formats to be treated, as is expected from such a system (packaging+machine).

Finally, it is understood that the examples provided above only constitute specific examples of the invention and are in no way limiting in terms of the scope of application of the invention.

The invention claimed is:

1. A packaging comprising two detachable elements respectively formed from cutouts of sheet-form card or corrugated card material, a first element forming a base of the packaging and a second element forming a lid of the packaging, wherein the cutouts of the first element comprise two main flaps, a first main flap forming a bottom of the packaging and a second main flap forming a side wall of the packaging, said flaps being connected by a first fold line directly or by a secondary flap, and a set of lateral tabs arranged on either side of at least one of said main flaps and connected to said main flaps by second fold lines perpendicular to the first fold line so that said elements exhibit the overall shape of a letter L;

wherein the cutouts of the second element comprise two main flaps, a first main flap forming a top of the packaging, and a second main flap forming a side wall of the packaging, said flaps being connected by a first fold line directly or by a secondary flap, and a set of lateral tabs arranged on either side of at least one of said main flaps and connected to said main flaps by second fold lines perpendicular to the first fold line so that said elements exhibit the overall shape of a letter L;

wherein the first main flap of the cutouts of the first and second elements is of quadrilateral shape, the four corners of the first main flap being chamfered;

wherein the width of the first main flap forming the bottom of the packaging and the lateral tabs connected to said first main flap is greater than the width of the second main flap forming side wall and the lateral tabs connected to said second main flap; and wherein the width of the first main flap forming the top of the packaging and the lateral tabs connected to said first main flap is greater than the width of the second main flap forming side wall and the lateral tabs connected to said second main flap.

2. The packaging according to claim 1, wherein the first main flap is of rectangular shape and wherein the second main flap is of rectangular shape, the long side of which is shorter than the long side of the first main flap.

3. The packaging according to claim 1, wherein the lateral tabs of the first main flap have a length that is longer than the long side of said first main flap, between two chamfered corners.

4. The packaging according to claim 3, wherein the lateral tabs of the first main flap protrude from the chamfered corners in the direction of the second main flap.

5. The packaging according to claim 4, wherein each lateral tab of the first main flap comprises a third fold line, parallel to the first fold line.

6. The packaging according to claim 3, wherein the lateral tabs of the first main flap protrude from the chamfered corners in a direction opposite to that of the second main flap.

7. The packaging according to claim 6, wherein each lateral tab of the first main flap comprises two third fold lines extending in the part protruding from the chamfered corner in a direction opposite that of the second main flap.

8. The packaging according to claim 1, wherein the lateral tabs of the second main flap extend over the entire length of the long side of said second main flap.

9. The packaging according to claim 8, wherein the lateral tabs of the second main flap have a width that is equal to the length of the chamfered corners of the first main flap.

10. The packaging according to claim 1, wherein the first main flap is ended by an attachment strip connected to said first main flap by a first fold line.

11. The packaging according to claim 1, wherein the lateral tabs of the first main flap have a width that is equal to the length of the chamfered corners of the first main flap.

12. The packaging according to claim 1, wherein the lateral tabs of the first main flap have a width that is equal to the length of the long side of the second main flap.

13. The packaging according to claim 1, wherein the first main flap and/or the second main flap of at least one of the elements comprise an oblong cavity forming a gripping handle.

14. The packaging according to claim 1, wherein the lateral sides of the lateral tabs of the second main flap, opposite the first main flap, of a first element comprise respectively a tenon to be introduced in a mortise provided in the first main flap, at the level of the corners opposite the second main flap of a second element.

15. The packaging according to claim 1, wherein the cutouts of the first and second elements are identical.

16. The packaging according to claim 1, wherein the cutouts of the first and second elements are different.

17. A cutout for a packaging comprising two detachable elements respectively formed from cutouts of sheet-form card or corrugated card material, a first element forming a base of the packaging and a second element forming a lid of the packaging, said cutout comprising two main flaps, a first main flap of quadrilateral shape and with four chamfered corners and a second main flap also of quadrilateral shape, said flaps being connected by a first fold line directly or by a secondary flap, and a set of lateral tabs arranged on either side of at least one of said main flaps and connected to said main flaps by second fold lines perpendicular to the first fold line, wherein the width of the first main flap and the lateral tabs connected to said first main flap is greater than the width of the second main flap and the lateral tabs connected to said second main flap.

18. The cutout for a packaging according to claim 17, wherein the first main flap is of rectangular shape and wherein the second main flap is of rectangular shape, the long side of which is shorter than the long side of the first main flap.

19. The cutout for a packaging according to claim 17, wherein the lateral tabs of the first main flap have a length that is longer than the long side of said first main flap, between two chamfered corners.

20. The cutout for a packaging according to claim 19, wherein the lateral tabs of the first main flap protrude from the chamfered corners in the direction of the second main flap.

21. The cutout for a packaging according to claim 20, wherein each lateral tab of the first main flap comprises a third fold line, parallel to the first fold line and extending in a part protruding from the chamfered corner.

22. The cutout for a packaging according to claim 19, wherein the lateral tabs of the first main flap protrude from the chamfered corners in a direction opposite to that of the second main flap.

23. The cutout for a packaging according to claim 22, wherein each lateral tab of the first main flap comprises two third fold lines extending in the part protruding from the chamfered corner in a direction opposite that of the second main flap.

24. The cutout for a packaging according to claim 17, wherein the lateral tabs of the second main flap extend over the entire length of the long side of said second main flap.

25. The cutout for a packaging according to claim 24, wherein the lateral tabs of the second main flap have a width that is equal to the length of the chamfered corners of the first main flap.

26. The cutout for a packaging according to claim 17, wherein the first main flap is ended by an attachment strip connected to said first main flap by a first fold line.

27. The cutout for a packaging according to claim 17, wherein the lateral tabs of the first main flap have a width that is equal to the length of the chamfered corners of the first main flap.

28. The cutout for a packaging according to claim 17, wherein the lateral tabs of the first main flap have a width that is equal to the length of the long side of the second main flap.

29. The cutout for a packaging according to claim 17, wherein the first main flap and/or the second main flap comprise an oblong cavity forming a gripping handle.

30. The cutout for a packaging according to claim 17, wherein the lateral sides of the lateral tabs of the second main flap, opposite the first main flap, comprise respectively a tenon to be introduced in an oblique mortise provided in the first main flap, at the level of the corners opposite the second main flap of a second element.

31. A packaging comprising two detachable elements respectively formed from cutouts of sheet-form card or corrugated card material, a first element forming a base of the packaging and a second element forming a lid of the packaging, wherein the cutouts of the first element comprise two main flaps, a first main flap forming a bottom of the packaging and a second main flap forming a side wall of the packaging, said flaps being connected by a first fold line directly or by a secondary flap, and a set of lateral tabs arranged on either side of at least one of said main flaps and connected to said main flaps by second fold lines perpendicular to the first fold line so that said elements exhibit the overall shape of a letter L;

wherein the cutouts of the and second elements comprise two main flaps, a first main flap forming the bottom of the packaging and a top of the packaging respectively, and a second main flap forming a side wall of the packaging, said flaps being connected by a first fold line directly or by a secondary flap, and a set of lateral tabs arranged on either side of at least one of said main flaps and connected to said main flaps by second fold lines perpendicular to the first fold line so that said elements exhibit the overall shape of a letter L, wherein the first main flap of the cutouts of the first and second elements is of quadrilateral shape, the four corners of the first main flap being chamfered; and wherein each lateral tab of the first main flap comprises two third fold lines that extend in the part protruding from the chamfered corner in the direction opposite that of the second main flap, the third fold lines extending to the angles of the chamfered corners and the distance between the two fold lines being equal to the length of the chamfered corner, to form attachments strips, the inner walls of the attachment strips of the base and of the lid being glued to the outer walls of the second main flap of the lid and of the base respectively.

* * * * *